US010406063B2

(12) United States Patent
Mitchell et al.

(10) Patent No.: US 10,406,063 B2
(45) Date of Patent: Sep. 10, 2019

(54) MEDICAL EQUIPMENT FOR HIGH FREQUENCY CHEST WALL OSCILLATION (HFCWO) TREATMENT

(71) Applicant: RESPINNOVATION, Seillans (FR)

(72) Inventors: Barrett Reed Mitchell, Seillans (FR); Fausto Parazzini, Bresso (IT)

(73) Assignee: RESPINNOVATION, Seillans (FR)

( * ) Notice: Subject to any disclaimer, the term of this patent is extended or adjusted under 35 U.S.C. 154(b) by 921 days.

(21) Appl. No.: 14/890,949

(22) PCT Filed: May 15, 2014

(86) PCT No.: PCT/EP2014/059982
§ 371 (c)(1),
(2) Date: Nov. 13, 2015

(87) PCT Pub. No.: WO2014/184304
PCT Pub. Date: Nov. 20, 2014

(65) Prior Publication Data

US 2016/0101014 A1 Apr. 14, 2016

(30) Foreign Application Priority Data

May 15, 2013 (EP) ..... 13167949

(51) Int. Cl.
*A61H 23/00* (2006.01)
*A61H 23/04* (2006.01)
*A61H 9/00* (2006.01)

(52) U.S. Cl.
CPC ..... *A61H 9/0078* (2013.01); *A61H 23/006* (2013.01); *A61H 2201/165* (2013.01);
(Continued)

(58) Field of Classification Search
CPC ..... A61H 9/00; A61H 9/005; A61H 9/0078; A61H 9/0007; A61H 2201/165;
(Continued)

(56) References Cited

U.S. PATENT DOCUMENTS 3,483,862 A * 12/1969 Takeuchi Shigeo ... A61H 39/04 297/396
5,558,398 A * 9/1996 Santos ..... A47C 4/54 297/284.3

(Continued)

FOREIGN PATENT DOCUMENTS

WO 93/17650 9/1993

OTHER PUBLICATIONS

Translation of Molnar DE 4207054 (Year: 1993).*
International Search Report dated Aug. 12, 2014, corresponding to PCT/EP2014/059982.

*Primary Examiner* — Michael J Tsai
*Assistant Examiner* — Christopher E Miller
(74) *Attorney, Agent, or Firm* — Young & Thompson

(57) ABSTRACT

Medical equipment for High Frequency Chest Wall Oscillation treatment to be worn on a thorax, includes a plurality of pressure devices arranged to apply repetitive compressions to the thorax and each including a deformable chamber and at least a port communicating with the chamber configured to let a pressurized fluid flowing alternatively in and out the chamber so that the pressure device alternatively passes from an inflated configuration to a deflated configuration, the equipment including at least a frame for holding the pressure devices substantially perpendicular to the thorax, an outer face of the base being in contact with an inner face of the frame, wherein at least some of the pressure devices are aligned, two consecutive pressure devices being connected together by at least two tubes the distance (D)
(Continued)

between the inner face of the frame and each tube connecting two consecutives pressure devices being inferior to 8 mm.

15 Claims, 10 Drawing Sheets

(52) U.S. Cl.
CPC ..... *A61H 2201/1619* (2013.01); *A61H 2201/1621* (2013.01); *A61H 2201/1664* (2013.01); *A61H 2205/084* (2013.01)

(58) Field of Classification Search
CPC ..... A61H 2201/1619; A61H 2205/08; A61H 1/00; A61M 16/0006
See application file for complete search history.

(56) References Cited

U.S. PATENT DOCUMENTS 5,607,749 A * 3/1997 Strumor ..... A43B 7/146 428/156
6,212,719 B1 * 4/2001 Thomas ..... A47C 4/54 297/284.6
6,254,556 B1 * 7/2001 Hansen ..... A61H 9/0078 137/565.16
6,312,400 B1 * 11/2001 Itikawa ..... A61H 7/004 601/100
6,336,907 B1 * 1/2002 Dono ..... A47C 7/467 601/148
6,551,450 B1 * 4/2003 Thomas ..... A61H 9/0078 156/580.1
6,916,300 B2 * 7/2005 Hester ..... A61H 23/04 297/284.6
8,007,417 B2 * 8/2011 Heller ..... A63B 22/18 482/112
8,578,939 B1 * 11/2013 Kimani Mwangi ..... A61F 5/56 128/848
9,603,771 B1 * 3/2017 Alvarez ..... A61H 31/00
2005/0070405 A1 * 3/2005 Egger ..... A61H 9/005 482/78
2005/0177952 A1 * 8/2005 Wilkinson ..... A47C 27/084 5/713
2006/0085919 A1 * 4/2006 Kramer ..... A47C 27/082 5/713
2006/0217644 A1 * 9/2006 Ozaki ..... A61H 9/0078 601/148
2007/0239087 A1 * 10/2007 Kivisto ..... A61H 9/0078 601/44
2008/0000477 A1 * 1/2008 Huster ..... A61B 34/25 128/204.23
2008/0080793 A1 * 4/2008 Kitou ..... A61H 9/0078 383/3
2008/0262396 A1 10/2008 Biggie et al.
2011/0203589 A1 * 8/2011 Fenton ..... A61M 16/0072 128/205.13
2014/0005579 A1 * 1/2014 Drlik ..... A61H 23/0218 601/111
2014/0257153 A1 * 9/2014 Nickelson ..... A61H 23/0263 601/150
2015/0025425 A1 * 1/2015 Mitchell ..... A61H 9/0078 601/96

* cited by examiner

MEDICAL EQUIPMENT FOR HIGH FREQUENCY CHEST WALL OSCILLATION (HFCWO) TREATMENT

TECHNICAL FIELD

The invention relates in general to a medical device applying repetitive compressions to the body of a human helping her/him to loosen mucus from the lungs and trachea, improve the blood circulation and the exchanges of carbon dioxide ($CO_2$) and oxygen ($O_2$).

More specifically, the present invention relates to High Frequency Chest Compression (HFCC) therapy also known as High Frequency Chest Wall Oscillation (HFCWO) therapy systems, especially but not limited to (HFCC)/HFCWO therapy systems suitable for use in a hospital or in a healthcare facility and home care use.

Under normal conditions, the human body efficiently clears mucus from the lungs and the respiratory tract by way of coughs.

Irregularities in the normal mucociliary transport system or hyper secretion of respiratory mucus results in an accumulation of mucus in the lungs causing severe medical complications such as hypoxemia, hypercapnia, chronic bronchitis and pneumonia.

Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease (COPD), asthma, and immotile cilia syndrome. Exposure to cigarette smoke, air pollutants and viral infections also negatively affect mucociliary function. Post-surgical patients, paralyzed persons, patients suffering from neuromuscular diseases, long term care bedridden patients, and newborns with respiratory distress syndrome also exhibit reduced mucociliary transport.

Chest physiotherapy (CPT) is a well-known method for treating patients with one or more of the above health conditions. Several methods of chest physiotherapy exist.

Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and postural draining of the loosened mucus toward the mouth. Active coughing is required to ultimately expectorate the loosened mucus. CPT requires the assistance of a trained caregiver, often a family member if a nurse or respiratory therapist is not available. It is a physically exhausting process for both the CF patient and the caregiver.

Artificial respiration devices for applying and relieving pressure on the chest of a person have been used to assist lung breathing functions, by loosening and helping the elimination of mucus from the lungs of persons with cystic fibrosis (CF). These devices use jackets having air accommodating bladders that surround the thorax of the patient. The bladder worn around the thorax of the CF patient is constantly inflated and compresses the thorax, the flow of air into the bladder is then cut/interrupted repeatedly which alternatively compresses and releases of the thorax at frequencies as high as 25 cycles per second. Each compression produces a rush of air through the lobes of the lungs that shears the secretions from the sidewalls of the airways and helps move them toward the larger central bronchial airways where they can be expectorated by normal coughing.

One of the most efficient treatments is High Frequency Chest Compression (HFCC) therapy also known as High Frequency Chest Wall Oscillation (HFCWO) also commonly referred to as airway clearance jackets or vests. Treatments using (HFCC)/HFCWO are well-known in the art.

Existing solutions describe a vest connected to a pulsed air generator via a tube. The entrance of the tube in the vest is reversible so the generator can be positioned on both sides of the vest while in use. So the vest receives pulsed air that inflates and deflates it. This helps the mucociliary transport activity. However, any further increase of efficiency of these systems would be very advantageous.

Indeed, an improved efficiency allows expectorating more mucus. In addition, it allows shortening the duration required for obtaining a satisfactory healing for a given patient which allows treating additional patients with the same HFCWO equipment.

The objective of the present invention is to increase the treatment efficiency compared to the existing solutions. An additional objective would be to enhance the efficiency of the treatment while limiting the cost of the equipment. Indeed, most of the known equipments for HFCWO are very costly and hardly affordable for many healthcare centers.

SUMMARY

The foregoing and other objectives are fulfilled at least partially, and other advantages are realized, in accordance with the embodiments of this invention.

According to an embodiment, the invention relates to a medical equipment for High Frequency Chest Wall Oscillation (HFCWO) treatment configured to be worn on a thorax and to apply repetitive compressions to the thorax. The medical equipment comprises a plurality of pressure devices configured to apply the repetitive compressions and comprising each a deformable chamber and at least a port in communication with the chamber arranged to let a pressurized fluid flowing alternatively in and out the chamber so that the pressure device alternatively passes from an inflated configuration to a deflated configuration.

Preferably, the medical equipment also comprises at least a frame for holding the pressure devices substantially perpendicular to the thorax i.e., the extension of the body is perpendicular to the surface of the thorax where the pressure device applies. Preferably, an outer face of the base is in contact with an inner face of the frame.

Preferably, at least some of the pressure devices are aligned, two consecutive pressure devices of a line being connected together by at least one tube and preferably by at least two tubes.

Preferably, the distance between each tube connecting two consecutives pressure devices and the inner face of the frame being inferior to 8 mm.

Thus, the two tubes are very near the inner face of the frame. Therefore, if a pressure device tends to tilt from a position where it is perpendicular to the frame and the thorax, the tubes generate an opposition force that maintains the pressure device in its perpendicular position.

During the achievement of the present invention it has turned out that without the present invention the pressure devices often tend to incline from their position where there are perpendicular to the frame and the thorax. In addition, it has been identified that even if the pressure device are slightly tilted from their perpendicular position, only a very small amount of the energy of the compression is actually transferred to the thorax. Therefore, the efficiency of the all treatment is greatly reduced.

Therefore, by limiting the inclination of the pressure device around a position wherein its base is firmly in contact with the inner face of the frame, the invention allows maintaining the pressure device in the correct position and enhances the efficiency of the treatment. This increased efficiency is obtained while reducing significantly the complexity of the assembly. Indeed, the pressure devices do not need to be each inserted in housing to maintain them. The time required to assemble the equipment and the cost are therefore greatly reduced.

The medical equipment is configured so that, at least when a pressure device tends to incline from a position wherein it is perpendicular to the frame and the thorax, at least a tube comes into contact with the inner face of the frame and thereby stops any further displacement of the pressure device.

With the device of the invention, the deformation of the device when it expends is high according to one direction and is null or low according to the other directions. The device acts as an air piston having a head that operates repetitive translations to transfer focused pulsations to the patient's body. Contrarily to existing systems, the device does not significantly expand along directions that are transverse to the one of the patient chest wall. The force generated by the inflation of the device can therefore be focused on the areas of the patient that are relevant for an efficient treatment. All, or at least almost all pressure provided in the chamber contributes to generate a useful force, also referred to as therapeutic pulsation, for the patient. Therefore, the invention allows a reduction of the overall pressure to be provided to the chamber while increasing or maintaining the amplitude of the force applied in a direction substantially perpendicular to the patient's body.

The invention may also comprise any one of the following optional and non-limitative features mentioned below.

Typically, the medical equipment is a vest.

Preferably, the inner face of the frame being in regard with the thorax and the outer face of the base projecting outward the thorax.

According to a preferred but not limitative embodiment the head, the body and the base form a single part.

Preferably, the pressure device comprises a body forming at least a part of the chamber, a head configured to apply a focused pulsation on the thorax during usage, and a base, the body extending between the base and the head and comprising bellows arranged for automatically decreasing the length of the body and bringing the pressure device back to its deflated configuration when the chamber is not supplied with pressurized fluid.

Preferably, the base comprises: at least an inlet port for feeding the chamber with pressurized fluid and at least an outlet port for allowing the pressurized fluid to evacuate the chamber.

Preferably, the head of the pressure device comprises an impact face configured to apply repetitive compressions to the thorax and the dimension of the impact face is comprised between 3 cm and 8 cm.

Preferably, at least a tube comprises an outer airtight envelope and a reinforcement structure housed inside the envelope. This allows enhancing the rigidity of the assembly comprising the pressure device and the tubes, preventing thereby any rotation of the pressure devices around an axis substantially perpendicular to the tubes connecting that pressure device.

Preferably, the distance between each tube connecting two consecutives pressure devices and the inner face of the frame is inferior to 6 mm.

Preferably, the distance between each tube connecting two consecutives pressure devices and the inner face of the frame is comprised between 0 and 4 mm. Preferably, the distance between each tube connecting two consecutives pressure devices and the inner face of the frame is comprised between 0 and 3 mm. Preferably, the tubes are in contact with the inner face of the frame.

Advantageously, the two tubes connecting two consecutives pressure devices are comprised in a plane that is substantially parallel to the inner face of the frame.

Advantageously, the two tubes connecting two consecutives pressure devices are parallel to each other.

Advantageously, the two tubes connecting two consecutives pressure devices form a line or a curve.

Advantageously, the two tubes connecting two consecutives pressure devices extend substantially linearly and form together an angle comprised between 0 and 30 degrees and preferably between 0 and 15 degrees.

Advantageously, the outer diameter of the tubes is comprised between 16.5 mm and 17.5 mm, and 17 mm is a preferred embodiment. Advantageously, the inner diameter of the tubes is comprised between 11.5 mm and 12.5 mm, and 12 mm is a preferred embodiment. Advantageously, the rigidity of the tubes is comprised between a hardness of 62 Shore A and a tensile strength >7.5 MPa. Advantageously, the material of the tube can be for instance silicon.

Preferably, more than half of the surface of the outer face of the base is in contact with the inner face of the frame. Preferably, more than ⅔ of the surface of the outer face of the base is in contact with the inner face of the frame. Preferably the outer face of the base is flat. Preferably, the entire surface of the outer face of the base is in contact with the inner face of the frame. Therefore, the reaction strength that the thorax applies against the pressure device and that tends to push back the pressure device towards the inner face of the frame is transferred to the inner face of the frame by a large surface. Therefore the pressure between the pressure device and the inner face of the frame is limited. The deformation of the frame is thus limited. The pressure devices are therefore firmly maintained in their correct position perpendicular to the chest. In addition, the wear of the frame is limited and its lifespan is increased.

Advantageously, at least two pressure devices and preferably three pressure devices form a line of pressure devices, at least two of these pressure devices comprising each four ports.

Typically, for adults, a line of pressure devices comprises 2 to 6 pressure devices. For infant, a line comprises 2 or 3 pressure devices.

Advantageously, each port is permanently open i.e., the pressure device is arranged so that at every moment of the operation, the fluid can freely communicate between the inside and the outside of the pressure device. The ports are never closed. They always allow the passage of air in or out the chamber. These ports do not contain any valve. They all do not interrupt the flow of air.

For each pressure device comprising four ports, one first port is an inlet port for letting the pressurized fluid flow into the chamber when the pressure is rising, the pressurized fluid coming from upstream when the pressure is rising, one second port is an outlet port for letting the pressurized fluid flow out of the chamber and towards a pressure device located in the line and downstream when the pressure is rising, one third port is an inlet port for letting the pressurized fluid that is coming from upstream when the pressure is decreasing flow into the chamber when the pressure is decreasing, one fourth port is an outlet port for letting the pressurized fluid flow out of the chamber and towards a pressure device located in the line and downstream when the pressure is decreasing.

Advantageously, the first and third ports are connected to a pressure device of the line and the second and fourth ports are connected to another pressure device of the line.

Advantageously, the tubes connected to the first and third ports are parallel and form together an angle comprised between 0 and 15 degrees and the tubes connected to the second and fourth ports are parallel and form together an angle comprised between 0 and 15 degrees.

Advantageously, the tubes connected to the first and second ports are aligned and the tubes connected to the third and fourth ports are aligned.

Advantageously, the pressure device located at a proximal end of a line is connected to a tube in communication with an air supply and the pressure device located at a distal end of a line comprises only two ports, one port being connected to a tube that supplies the chamber with pressurized air and one port connected to a tube for letting the air evacuate the chamber.

Advantageously, the medical equipment comprises at least a fastener that fastens the frame to the pressure device.

Advantageously, the medical equipment comprises at least a fastener that fastens the frame to at least a tube.

Advantageously, the medical equipment comprises at least a fastener that fastens the frame to two tubes connecting two consecutives pressure devices.

Advantageously, this allows preventing any rotation of the pressure device according to a direction that is substantially parallel to the tubes connecting that pressure device.

Preferably, the fastener surrounds and clasps the two tubes and the frame. This enables assembling the medical equipment very easily.

Preferably, the fastener is a cable tie, also called zip tie or tie-wrap. Alternatively or in combination, the fastener can be different, for instance they can be made of a metal or plastic clip or band.

Advantageously, this allows facilitating the fastening of the tubes and the pressure device on the frame. In addition, this allows limiting the cost of the equipment.

Advantageously, the frame comprises at least a recess or at least a hole through which passes the zip tie so that the zip tie does not slide along a direction that is parallel to the tubes i.e., parallel to the direction in which the support sub-frame extends.

Therefore, the whole line of pressure device and tubes is firmly hold against the inner face of the frame and cannot slide on it.

The invention also relates to a method for fabricating a medical equipment. The method comprises the following steps:

a step of forming a line of pressure devices, this step comprising connecting a plurality of pressure devices with tubes, disposing the line of pressure devices on the frame, the outer face of the pressure device being in contact with the inner face of the frame, fastening the line of pressure devices to the frame, preferably with a plurality of zip ties clasping tubes or pressure devices and the frame.

The invention provides therefore a method very simple and cost effective to obtain a medical equipment for HFCWO treatments.

According to a particular embodiment, the equipment comprises:

a plurality of support sub-frames configured to accommodate and fix the positions of the plurality of pressure devices, the plurality of support sub-frames forming strips able to comply with a shape of the body of the patient, each strip extending along one main direction, at least a binding support arranged to link at least two of the plurality of support sub-frames in order to sustain the at least one frame to comply with the shape of the patient's body and to prevent the plurality of support sub-frames from being twisted around their respective main direction.

Preferably, the at least binding support comprises a vertical axis in parallel with the spine of the patient.

Preferably, the at least one frame and at least some of the support sub-frames are formed in a single piece. This allows providing a continuous support to the pressure devices to keep the pressure devices properly orientated at a 90 degree angle to the thorax of the patient. Advantageously, the frame forms a plate with possibly openings or holes.

At least one of the support sub-frames is composed of a pair of support arms, two proximal ends of the pair of support arms being coupled to the at least a binding support, the two support arms longitudinally extending in a downward direction substantially perpendicular to a direction along which the pressure devices retract and forming a downward and inner angle $\alpha$, $100° \leq \alpha \leq 180°$.

The frame comprises a front frame and a rear frame.

Each of the plurality of pressure devices comprises a deformable chamber and at least a port in communication with the chamber configured to let a pressurized fluid flow alternatively in and out the chamber so that the inflatable pressure device alternatively passes from an inflated configuration to a deflated configuration, characterized in that the pressure device is configured to essentially expand along a direction when passing from the deflated configuration to the inflated configuration.

Each pressure device retracts along the direction so as to give a pressure substantially perpendicular to at least one rib of the patient's thorax.

Each pressure device retracts along the direction so as to give a pressure substantially perpendicular to two adjacent ribs of the patient's thorax.

At least one of the plurality of support sub-frames of the at least a frame is arranged to cover the lower lobes of the patient's lungs.

The flexibility of a material utilized for producing the at least a frame allows the at least a frame to comply with the shape of each individual patient's thorax, the thickness of the at least one frame being comprised between 0.8 and 1.5 mm.

Each of the plurality of support sub-frames accommodates n pressure devices, n being an integer; the n pressure devices do not overlap with each other and are evenly distributed on said support sub-frame; when n is odd, one of the n pressure device being mounted on an intersection of said support sub-frame and the at least a binding support, $(n-1)/2$ pressure devices being mounted on each half of said support sub-frame; when n is even, n/2 pressure devices being mounted on each half of said support sub-frame.

According to a particular embodiment, the medical equipment comprises a shroud comprising at least an elastic portion and configured to surround an outer face of the frame so that it compresses the pressure devices onto the thorax when the medical equipment is worn.

Preferably, the shroud is configured so that the plurality of pressure devices is tight against the thorax with an even distribution of pressure around the entire circumference of the thorax.

Advantageously, the shroud also allows firmly maintaining the pressure device between the thorax and the inner face of the frame. Therefore, the elastic shroud reduces the movement between the pressure device and the frame. Thus, the elastic shroud helps maintaining the pressure device in their correct position. The pressure device remains perpendicular to the thorax and transfers a maximum of energy to the rib cage which allows maintaining a very high efficiency.

Preferably, the shroud forms a jacket or a wrap comprising elastic portions.

Preferably, the shroud comprises at least two elastic portions respectively located under the shoulders and on one side of the thorax when the medical equipment is worn.

Advantageously; the shroud comprises at least a pocket configured to house at least a part of the frame so that the shroud holds at least a part of the frame. Preferably, the entire frame is hold by the at least one pocket of the shroud.

Alternatively or in combination, the equipment comprises elastic portions that are configured to be disposed over shoulders to pull upper the piston lines firm against thorax.

Preferably, the head of the pressure device comprises an impact face or outer face configured to apply repetitive compressions or focused pulsations to the thorax and the dimension of the impact face is configured to apply on at least two adjacent ribs, preferably whatever is its position.

Preferably, the dimension of the outer surface, according to a direction parallel to the spinal column, is longer than the average distance between two ribs adjacently disposed according to a direction parallel to the spinal column.

Preferably, said dimension is longer than the average distance between three ribs adjacently disposed according to a direction parallel to the spinal column.

Preferably, the dimension of the impact face of the head taken in a direction that is substantially parallel to the spinal column of the patient is comprised between 3 cm and 8 cm. In the present description, the spinal column is considered as extending along a vertical axis.

Preferably, the head of the pressure device comprises an impact face configured to apply repetitive compressions or focused pulsations against the thorax and the impact face has an elongated shape, the dimension of the impact face according to a direction parallel to the spinal column being greater than its dimension according to a direction perpendicular to the spinal column.

Advantageously, this ensures that the pressure device is always in contact with two ribs while reducing the surface of the head compared to a circular shape having a diameter of the size of the length. Therefore, the size and the volume of the pressure device are reduced. The volume of air required to move the head of the pressure device is therefore reduced with the embodiment of the invention while maintaining a constant efficiency of the treatment. Therefore, the flow of air is reduced in the equipment. The operation of the equipment is consequently less costly and much less noisy while preserving the efficiency of the treatment. Indeed, when developing the present invention it has turned out that the efficiency of the treatment is maintained if the surface of the head of the pressure device is reduced, provided the impact face of the pressure device transfers its energy on two ribs and not on the intercostal muscles.

The width of the impact face of the head extends perpendicularly to its length.

The length of the impact face of the head extends perpendicularly to its width and the length is greater than 1.5 times the width.

Preferably, the length is greater than 2 times the width. Preferably, the length is greater than 3 times the width. Preferably, the length is comprised between 1.5 and 5 times the width.

Preferably, the length is comprised between 3 cm and 8 cm and the width is comprised between 1 cm and 4 cm.

Preferably, the impact face of the head is oval. It presents an ellipsoidal shape in a plane parallel to the surface where it is supposed to stroke the thorax. This allows homogenizing the transfer of energy from the pressure device to the thorax. According to another embodiment, the impact face of the head is rectangular.

Preferably, the impact face of the head is flat. According to another embodiment, the impact face is convex or concave.

According to another embodiment, the invention relates to a method for fabricating a medical equipment characterized in that the method comprises the following steps:

- a step of forming a line of pressure devices, this step comprising connecting a plurality of pressure devices with tubes,
- disposing the line of pressure devices on the frame, so that an outer face of a base of the pressure device is in contact with an inner face of the frame,
- fastening the line of pressure devices to the frame through clasping tubes or pressure devices and the frame.

According to another embodiment, the invention relates to a medical equipment for High Frequency Chest Wall Oscillation system configured to apply repetitive compressions or focused pulsations to a thorax, the equipment comprises a plurality of pressure devices configured to apply repetitive compressions or focused pulsations to a thorax and, wherein the equipment also comprises a shroud configured to surround at least the thorax. The shroud comprises at least an elastic portion and is configured to surround the pressure devices so that it compresses the pressure devices against the thorax when the medical equipment is worn.

Preferably, the equipment comprises a at least a frame for holding the pressure devices and the shroud is arranged so that it surrounds an outer face of the frame and compresses the frame against the thorax which thereby presses the pressure device against the thorax.

Preferably, the shroud is configured so that the plurality of pressure devices is tight against the thorax with an even distribution of pressure around the entire circumference of the thorax.

The shroud can be utilized independently from the other features of the present invention. It may also be utilized in combination with all the other features of the present invention.

According to another embodiment, the invention relates to a medical equipment for High Frequency Chest Wall Oscillation (HFCWO) treatment configured to be worn on a thorax and to apply repetitive compressions to the thorax. The medical equipment comprises a plurality of pressure devices configured to apply the repetitive compressions and comprising each a deformable chamber and at least a port in communication with the chamber arranged to let a pressurized fluid flowing alternatively in and out the chamber so that the pressure device alternatively passes from an inflated configuration to a deflated configuration.

Preferably, the pressure device comprises a body forming at least a part of the chamber, a head configured to stroke the body of the patient during usage, and a base, the body extending between the base and the head and comprising bellows arranged for automatically decreasing the length of the body and bringing the pressure device back to its deflated configuration when the chamber is not supplied with pressurized fluid.

Preferably, the medical equipment also comprises at least a frame for holding the pressure devices substantially perpendicular to the thorax. Preferably, an outer face of the base being in contact with an inner face of the frame.

Preferably, the frame comprises a plurality of support sub-frames configured to accommodate and fix the positions of the plurality of pressure devices. Preferably, the plurality of support sub-frames form strips able to comply with a shape of the body of the patient, each strip extending along one main direction.

Preferably, the frame also comprises at least a binding support arranged to link at least two of the plurality of support sub-frames in order to sustain the at least one frame to comply with the shape of the patient's body. Preferably, the frame is arranged to prevent the plurality of support sub-frames from being twisted around their respective main direction.

Preferably, the at least binding support comprises a vertical axis configured to be disposed in parallel with the spine of the patient.

Preferably, the binding support and the support sub-frames are formed in a single piece.

A pressure device having such a frame can be utilized independently from the other features of the present invention. It may also be utilized in combination with all the other features of the present invention.

According to another embodiment, the invention relates to a medical equipment for High Frequency Chest Wall Oscillation (HFCWO) treatment configured to be worn on a thorax and to apply repetitive compressions to the thorax. The medical equipment comprises a plurality of pressure devices configured to apply the repetitive compressions and comprising each a deformable chamber and at least a port in communication with the chamber arranged to let a pressurized fluid flowing alternatively in and out the chamber so that the pressure device alternatively passes from an inflated configuration to a deflated configuration.

Preferably, the pressure device comprises a body forming at least a part of the chamber, a head configured to stroke the body of the patient during usage, and a base, the body extending between the base and the head and comprising bellows arranged for automatically decreasing the length of the body and bringing the pressure device back to its deflated configuration when the chamber is not supplied with pressurized fluid.

Preferably, the head of the pressure device comprises an impact face configured to apply the repetitive compressions or focused pulsations against the thorax and wherein the impact face has an elongated shape, the dimension of the impact face according to a direction parallel to the spinal column is greater than 3 cm and is greater than 1.5 times the dimension of the outer surface according to a direction perpendicular to the spinal column.

During the development of the present invention, it was identified that the pressure device may tend to move from its ideal position where it operates forth and back movements along an axis that is perpendicular to the surface of the thorax that it compresses. The pressure device may thus tend to be inclined from this perpendicular position. More precisely, the head of the pressure device may tend to slip and twist around a rib so that it applies its pressure on only one rib and possibly intercostal muscles. It was also found that the efficiency of the treatment may be significantly reduced if some of the pressure devices move from their ideal perpendicular position. Indeed, the transfer of energy is greatly reduced if the individual pressures generated by the pressure devices are not each transferred perpendicularly to the thorax.

The pressure device according to the invention allows the head to apply on at least two ribs, the stability of the impact face of the head is therefore significantly increased. Thus, the impact face of the pressure device does not slip or twist around a rib but remains in firm contact with at least two ribs. The impact face of the pressure device thus stays parallel to the thorax and the stroke generated by the pressure device is applied perpendicularly to the thorax.

In addition, it has been found that when the head of the pressure device contacts intercostal muscles instead of contacting only one or several ribs, a part of the energy generated by the pressure device is actually transferred to the intercostal muscles which absorbs this energy without transferring it to the rib cage. A fewer energy is therefore transferred to the rib cage to vibrate the lungs. The treatment is consequently much less efficient. Instead, the invention prevents the head of the pressure device from twisting and applying on the intercostal muscles. Therefore, the invention allows enhancing the efficiency of the treatment or allows reducing the compressions applied to the thorax for an efficiency equivalent to the one of the know systems which greatly reduces the pain of the patient during the treatment.

The invention may also comprise any one of the following optional and non-limitative features mentioned below.

Advantageously, the elongated shape of the impact face is configured to apply on at least two adjacent ribs whatever is its position.

Advantageously, the dimension of the outer surface, according to a direction parallel to the spinal column, is longer than the average distance between two ribs adjacently disposed according to a direction parallel to the spinal column.

Advantageously, said dimension parallel to the spinal column is longer than the average distance between three ribs adjacently disposed according to a direction parallel to the spinal column.

Advantageously, said dimension parallel to the spinal column is comprised between 3 cm and 8 cm.

Advantageously, the elongated shape presents a length and a width, the equipment being configured so that during the operation, the length extends substantially perpendicularly to the ribs on which the head applies and the width extends perpendicularly to its length and wherein the length is greater than 2 times the width.

Advantageously, the length is greater than 3 times the width.

Advantageously, the length is comprised between 1.5 and 5 times the width.

Advantageously, the impact face of the head is oval.

A pressure device having a head with an elongated shape can be utilized independently from the other features of the present invention. It may also be utilized in combination with all the other features of the present invention.

According to another embodiment, the invention relates to a pressure device configured to be incorporated in a medical equipment for High Frequency Chest Wall Oscillation (HFCWO) treatment, the pressure devices comprising a deformable chamber and at least a port in communication with the chamber so that the pressure device alternatively passes from an inflated configuration to a deflated configuration when a pressurized fluid alternatively flows in and out the chamber generating thereby repetitive compressions on a body.

Preferably, the pressure device comprises a body forming at least a part of the chamber, a head configured to stroke the body of the patient during usage, and a base, the body extending between the base and the head and comprising bellows arranged for automatically decreasing the length of the body and bringing the pressure device back to its deflated configuration when the chamber is not supplied with pressurized fluid.

The pressure device comprises an impact face configured to apply the repetitive compressions against the body. Advantageously the impact face has an elongated shape with an elongation along one main direction.

According to a particular embodiment, the dimension of the impact face along the main direction is greater than three centimeters.

According to a particular embodiment, the dimension of the impact face along the main direction is greater than 1.5 times the dimension of the impact face according to a direction perpendicular to said main direction.

According to a particular embodiment, the head, the body and the base form a single part.

As indicated earlier, each pressure device generate a stroke on the thorax and allows a reduction of the overall pressure to be provided to the chamber while increasing or maintaining the amplitude of the force applied in a direction substantially perpendicular to the patient's body.

In existing systems the pressure provided to each chamber of a HFCWO system generates important compressions that are at the very least uncomfortable and that are most of the time painful and stressing. Yet, it has turned out that because of that lack of comfort and that potential pain and stress, patients often reduce the time of the treatment, do it less often or even interrupt it, leading thereby to a non-optimal efficiency of the treatment. In some cases, this also leads to further costly medical interventions due to exacerbations of condition.

In addition, the operation of the medical equipment according to the present invention has no or has a low effect on patient's blood pressure as the existing devices do. Existing devices must carry warning labels and are not suitable for hypertensive, or potentially hypertensive, patients which restricts the range of uses and patients. The invention allows therefore enlarging the range of uses and of patients.

With the existing systems, the noise generated by the compression device feeding the chambers with air is very loud, more than 70 decibels, which prevents the patient (and also those around them) from doing other activity such as reading, working, talking, listening to music. This also makes use in certain clinical environments not possible further reducing patient use. This device according to the invention operates at 62 decibels, which is almost 8 to 10 times less noisy. In addition to being very uncomfortable and potentially painful and stressful, current HFCWO treatments are therefore very boring. As the device according to the invention allows reducing the necessary pressure, the noise generated through the compression device is significantly decreased. Patients can therefore use the invention while doing other activities. Additionally, the invention allows using a HFWCO equipment in a room where other people/patients are present. This feature of the invention is particularly advantageous since patients can therefore be treated in their health care facility room which is much simpler and cheaper than having a room dedicated to such treatment.

Through all these advantages, it appears clearly that the invention will result in a therapy that is more efficient and gentler for patients and at the same time greatly increasing the range of clinical applications and potential patients who could benefit from HFCWO therapy who cannot today due to limitations of existing devices. Clinicians estimate the range of clinical applications and patients will increase four to six times due to more controllable patient 'friendly' delivery system, much lower noise levels, but most importantly the ability to focus the pulsations to specific parts of the thorax allowing adjustments to therapy to meet individual patient's needs and clinical restrictions. The clinicians also feel the increased patient comfort from the massage like effect will greatly increase adhesion to and compliance with therapy regimes greatly increasing the efficiency and reducing exacerbations resulting in hospitalization.

Another aspect of the invention relates to a High Frequency Chest Wall Oscillation (HFCWO) system comprising a medical equipment according to any one of the preceding features and comprising means for delivering a pressurized fluid to the device. Therefore, the invention also relates to a medical apparatus that incorporates the equipment housing the device and that allows providing a HFCWO treatment.

Optionally and preferably, at least some of the devices are independently provided with a pressurized fluid. Each zone of the patient's body can therefore be provided with strokes or focused pulsations having specific frequencies and amplitudes. The treatment can be more efficient. In addition, this allows for not applying any strokes/focused pulsations to any zones of the body that are painful or that are recovering from a trauma or surgery.

According to another aspect, the invention relates to an inflatable device for applying repetitive focused pulsations or compressions on a patient's body, comprising at least a deformable chamber and at least a port in communication with the chamber configured to let a pressurized fluid flowing alternatively in and out the chamber so that the inflatable device alternatively passes from an inflated configuration to a deflated configuration, characterized in that the device is configured to essentially expand along one single direction when alternatively passing from an inflated configuration to a deflated configuration.

Another aspect of the present invention relates to a medical apparatus, for instance a garment or a stripe (wrap or band) to be worn, applied or attached on a chest, leg or arm and comprising a device according to any one of the above features. In addition, the medical apparatus is configured to be coupled with means for pressurizing the device. This can also be used as a Pad placed under a patient to avoid all the problems of getting a equipment or Wrap around the entire thorax of a patient in intensive care who is connected to various medical monitoring devices, ECG in particular, who can still benefit from the therapeutic pulsations over the entire rear of the thorax, thereby aiding the earliest clearance of the lungs and release from Intensive Care.

According to another aspect, the invention provides a method for treating a part of the body of a patient, where a medical apparatus comprising at least a device according to any one of the above features is placed in the vicinity of the body of the patient. The method comprising a step of repetitively applying a pressure into the chamber of the device so that the device alternatively passes from an inflated configuration to a deflated configuration, generating thereby pulsations onto the patient's body. As it will be detailed below, the method according to the invention enhances the efficiency of the treatment while allowing the reduction of the pressure constantly applied on the patient's body. It has been identified that the constant pressure applied onto the patient's body with the existing methods has a negative effect on the breathing and on the blood pressure and potentially other important physiological functions.

According to another aspect, the invention provides a method for treating a part of the body of a patient, where the treatment involves using a medical apparatus comprising an inflatable device as described above.

According to another aspect, the invention provides a High Frequency Chest Wall Oscillation (HFCWO) system comprising a medical equipment according to any one of the preceding embodiment and comprising means for delivering a pressurized fluid to the device.

According to another aspect, the invention provides a method for fabricating a medical equipment according to any one of the preceding claims the medical equipment comprising a plurality of pressure devices configured to apply repetitive compressions and comprising each a deformable chamber and at least an inlet port for feeding the chamber with pressurized fluid and at least an outlet port for allowing the pressurized fluid to evacuate the chamber in communication with the chamber so that the pressure device alternatively passes from an inflated configuration to a deflated configuration, the pressure device comprising a body forming at least a part of the chamber, a head configured to stroke the thorax during usage, and a base, the body extending between the base and the head and comprising bellows arranged for automatically decreasing the length of the body and bringing the pressure device back to its deflated configuration when the chamber is not supplied with pressurized fluid, the medical equipment also comprising at least a frame for holding the pressure devices substantially perpendicular to the thorax, at least some of the pressure devices being aligned, two consecutive pressure devices being connected together by at least two tubes, the method being characterized in that the it comprises the following steps:

- a step of forming a line of pressure devices, this step comprising connecting a plurality of pressure devices with the tubes,
- disposing the line of pressure devices on the frame, so that an outer face of a base of the pressure device is in contact with an inner face of the frame,
- fastening the line of pressure devices to the frame through clasping the tubes and the frame or through clasping the pressure devices and the frame.

BRIEF DESCRIPTION OF THE DRAWINGS

The foregoing and other aspects of the embodiments of this invention are made more evident in the following Detailed Description, when read in conjunction with the attached Drawing Figures, wherein.

DETAILED DESCRIPTION

Figure 1:
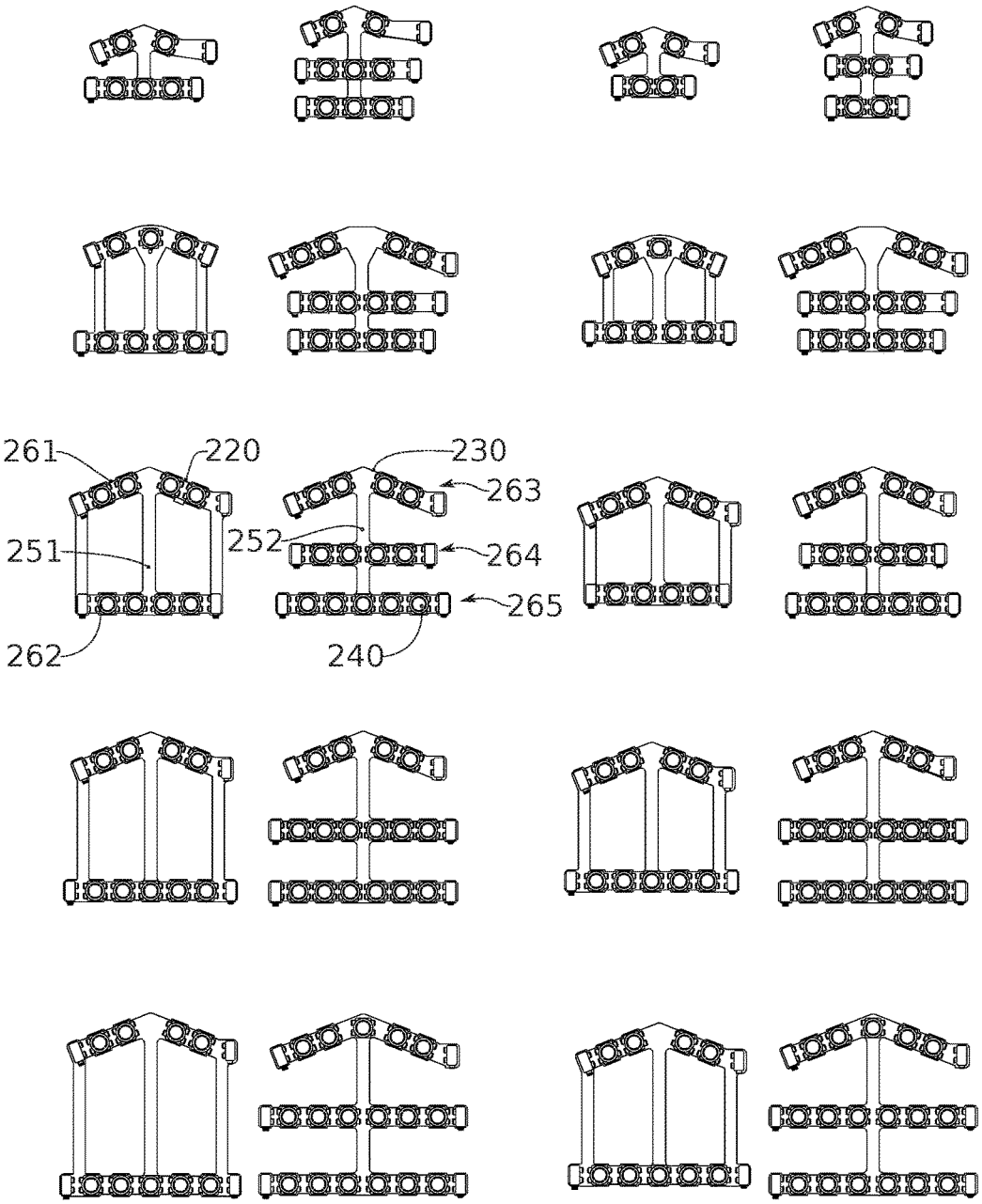
FIG. 1 is a schematic illustration of medical vests according to plurality of exemplary embodiments, the vests having various sizes, respectively for female and male according to an embodiment of the invention.

Some advantageous features and steps will be described below. Then some exemplary embodiments and use cases will be further detailed in regard with the drawings.

In the present invention a patient designates a person or an animal that receives a treatment. While a preferred embodiment relates to a medical vest intended to be worn on a person, the invention also turns out to be very efficient when used for animals such as horses and more particularly race horses since these horses often suffer from severe medical complications caused by an accumulation of mucus in the lungs.

In the present invention, a High Frequency Chest Wall Oscillation (HFCWO) system applies repetitive compressions or focused pulsations to the chest of a human or animal, the chest being either the front side of the body, either the back side of the body or either the right side or the left side of the body or being a combination of any of these zones. Thus the scope of protection of the present invention is not limited to medical vest applying repetitive compression only on the front of the trunk of a human or an animal. The present invention also encompasses vests applying repetitive compressions or focused pulsations only on the back side of the chest of a human or of an animal.

In the following the word vest will be used for designing both jackets and wraps that are configured to be worn on a chest or thorax of a human or of an animal.

A medical equipment 200 or medical garment 200 for HFCWO system according to the present invention is configured to apply repetitive compressions or focused pulsations to the thorax of a patient. According to a preferred embodiment, said medical equipment 200 comprises at least a frame comprising a plurality of pressure devices, also referred to as pressing devices, a plurality of support sub-frames and at least a binding support.

The plurality of pressure devices is utilized for giving a pressure substantially perpendicular to the thorax of the patient. The plurality of support sub-frames is configured to accommodate and fix the positions of the plurality of pressure devices and to comply with a shape of the body of the patient preferably while limiting or avoiding the possibility for the pressure devices to be twisted along an axis substantially parallel to surface of the body of the patient.

Each support sub-frame forms a strip or a tongue that partially surrounds the thorax when the vest is worn. When the vest is positioned on a plane, each support sub-frame extends substantially along one direction.

The at least one binding support is arranged to link at least two of the plurality of support sub-frames. The binding support mainly extends, in use, in a direction parallel to the spinal column. The frame thus may be seen as a rib cage wherein the support sub-frames would be the ribs. In the present description, the spinal column is considered as extending along a vertical axis, such as the axis referenced "Z" in FIG. 2*b*. The direction "X" that is perpendicular to the thorax and along which the pressure devices expand is therefore parallel to the direction "Z".

The frame is arranged so that the support sub-frames can bend around the thorax in order to tightly fit the latter.

Advantageously, the frame is arranged so that in use, it avoids or at least limits the rotation of the support sub-frame around an axis that is parallel to the main direction along which the support sub-frame extends. Therefore, the support sub-frame cannot be twisted. Preferably, in order to prevent or limit the twist of the support sub-frame, one end of the support sub-frame is linked to a binding support, the other end being linked to another binding support, to another support sub-frame or to a structure such as tubes.

The frame forms openings 253 between the support sub-frames and the binding support(s). These openings 253 allow facilitating the evacuation of the heat generated by the patient which enhances his comfort.

According to the front frame 220 of the present embodiment according to the invention, only one biding support 251 parallel with the spine of the patient is utilized for supporting and maintaining the support sub-frames 261, 262 to be respectively in their right positions. In this way, the front frame 220 insures that the pulsations generated by the pressure devices 240 mounted on the front frame 220 are directed at areas of least material between the point of the pressure devices 240 and ribcage to maximize energy transfer.

These openings 253 are also positioned to match with the pectoral muscles or the breasts of the patient. Therefore, the support sub-frames and pressure devices are configured not to apply on the pectoral muscles or the breasts. This is very advantageous since these areas of the chest absorb the majority of the pulsation energy generated by the pressure device and dissipate it, thereby greatly reducing the therapeutic efficiency.

As it will be explained with further details below, individual lines of pressure devices tend to slide and twist so that they cannot deliver a 90 degree perpendicular strike to the thorax of the patient, which causes in some cases most of the energy transfer of the pulsation to be lost. Indeed, the forth and back movements of the pressure devices must apply perpendicularly to the wall of the chest to provide an efficient treatment. Moreover, when the pressure devices move from their perpendicular position, they often hit intercostal muscles which absorb most of the energy of the strokes instead of hitting the ribs for transferring thereafter this energy from the ribs to the lungs.

With the known solutions, since the energy transfer cannot be delivered to the patient's chest in a sufficiently efficient way, the existing systems need to generate important strokes to the patient's chest in order to ensure the treatment effects. These strokes are often uncomfortable and often lead to reduce the time of each sequence of treatment. Additionally, it has turned out that in some cases, the patients are reluctant to do their treatment because of the discomfort. With existing solutions, healing is therefore limited or takes a longer period whereas the invention increases the focused energy transfer from the pressure devices to the lungs which allows reducing the strokes applied on the chest thereby providing more comfort to the patient.

Figure 2A:
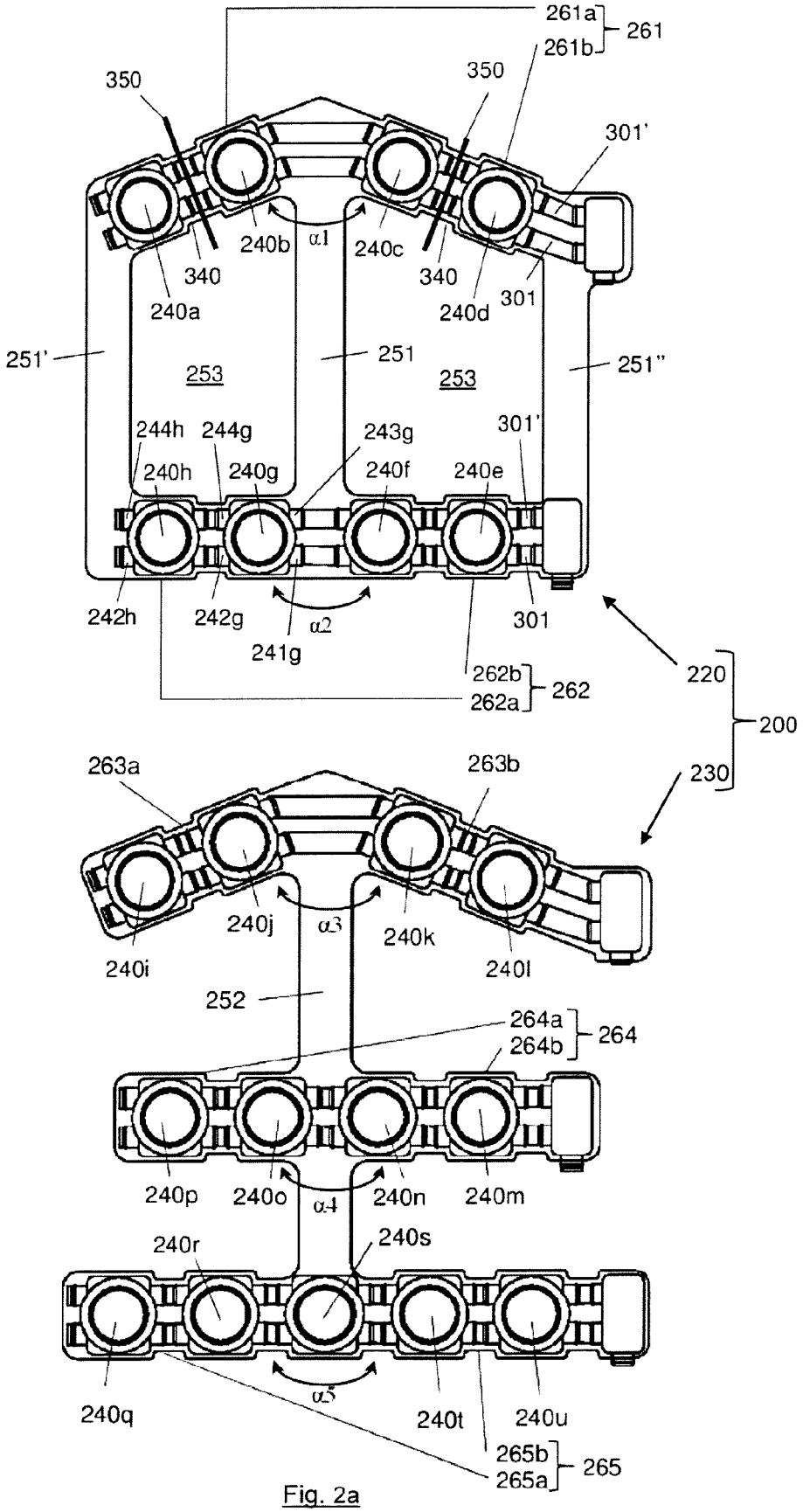
FIG. 2*a* illustrates an exemplary embodiment of a medical vest for HFCWO system shown on FIG. 1 for a female size M or L.

Some exemplary embodiments of medical vests 200 according to the invention will be now described in reference to FIGS. 1 and 2*a*. The medical vest 200 with various sizes respectively for female and male illustrated on FIG. 1 is provided in order to facilitate the understanding of the present invention. The detailed description of elements included in the medical vest 200 is provided on FIG. 2*a*.

Frame

FIG. 2*a* illustrates a detailed version of a medical vest 200 for HFCWO system shown on FIG. 1 for a female size M or L. The medical vest 200 comprises a front frame 220 and a rear frame 230 being respectively arranged to be worn on the front and the back side of the trunk of a patient and comprising respectively a plurality of pressure devices 240. As shown on FIG. 2*a*, the front frame 220 comprises 8 pressure devices 240*a*-240*h*, and the rear frame 230 comprises 13 pressure devices 240*i*-240*u*.

Figure 2B:
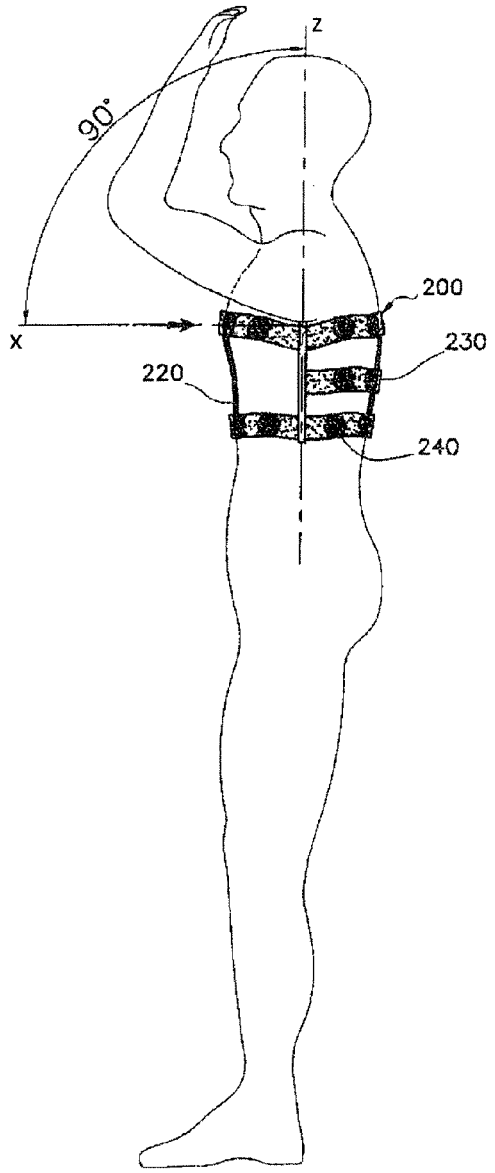
FIG. 2*b* illustrates a side view of a patient wearing the medical vest shown in FIG. 2*a*.

A pump (non illustrated on FIG. 2*a*) is arranged to provide a pressurized fluid, typically air, to the medical vest 200. To this end, a plurality of ducts or tubes 300 (illustrated for the front side of FIG. 2*a* only) are connected to said pump and a plurality of pressure devices 240. When a pressure device 240 is actuated by for example through being filled with pressurized air, it inflates and generates a stroke on the patient's body to give a pressure substantially perpendicular to the thorax of the patient, as shown in FIG. 2*b* illustrating a side view of a patient wearing the medical vest 200.

Front Frame

The front frame 220 comprises a front vertical axis 251, a plurality of support sub-frames 261, 262, and a plurality of pressure devices 240. The structure of said pressure devices 240 will be presented later in detail.

As shown on FIG. 2*a*, a first support sub-frame 261 and a second support sub-frame 262 are configured to accommodate and fix the positions of the plurality of pressure devices 240 and to comply with a shape of the front side of the trunk of the patient without being rotated or twisted along a transversal axis substantially parallel to surface of the front side of the patient's trunk.

In order to achieve the above function, the support sub-frames 261, 262 are made of a flexible material with high tenacity, such as the plastic VIVAC. The support sub-frames 261, 262 can therefore be sufficiently rigid to insure resistance to give a continuous support and prevent themselves from being rotated or twisted in the above-mentioned way. The flexibility of said material allows the support sub-frames 261, 262 to be still sufficiently flexible to comply with the shape of each individual patient's thorax.

The thickness of the support sub-frames 261, 262 is comprised between 0.8 and 1.5 mm, preferably 1 mm.

In addition, the plurality of pressure devices 240 attached to the support sub-frames 261, 262 are kept properly orientated at a 90 degree angle to the thorax of the patient. The medical vest 200 increases thus energy transfer by reducing the lost energy by keeping the pressure devices 240 substantially perpendicular to the thorax of the patient with being able to twist or slide or slip.

According to the preferred embodiment illustrated on FIG. 2*a*, the support sub-frame 261 is composed of a first pair of support arms 261*a*, 261*b*. Two proximal ends of the two support arms 261*a*, 261*b* are coupled to the vertical axis 251 and thus form an intersection of the vertical axis 251 and the support sub-frame 261. In the present embodiment, said intersection on the upper end of the vertical axis 251 corresponds to the upper end of the rib cage.

When the medical vest 200 is worn on the patient, the two support arms 261*a*, 261*b* longitudinally extend in a downward direction substantially perpendicular to the direction 211 along which the pressure devices 240 retracts and form a downward and inner angle $\alpha 1$. The preferably range of the angle $\alpha 1$ is, $100° \leq \alpha 1 \leq 180°$, but not limited thereto. In the present embodiment, the inner angle $\alpha 1$ is 150°.

For a female patient with size M or L, the length of each of the support arms 261*a*, 261*b* is comprised between 170 and 200 mm, preferably 175 mm; the width of each of the support arms 261*a*, 261*b* is comprised between 50 and 60 mm, preferably 55 mm.

The present invention is not limited to the size of the support sub-frame 261 of the front frame 220 according to the above example.

It should be noted that the implementation of the first support sub-frame 261 is not limited to the above preferred embodiment. For example, the first support sub-frame 261 can be made with a single piece of an arc shape.

Figure 3A:
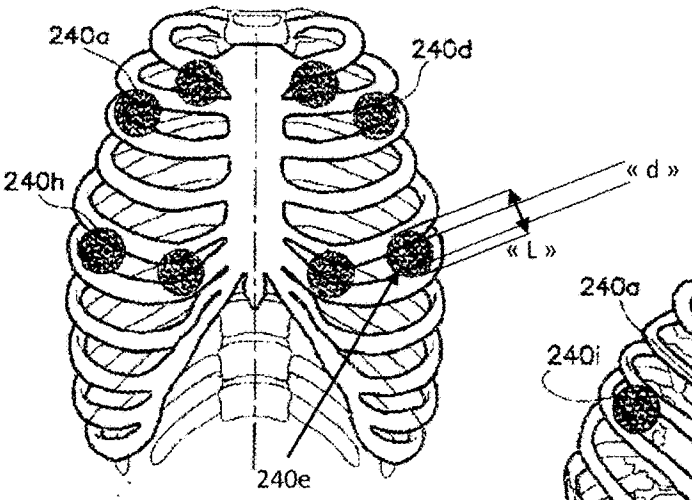
FIGS. 3*a* to 3*b* illustrate the heads of the pressure devices positioned on the thorax, the impact face of the pressure devices having a circular shape.
Figure 4D:
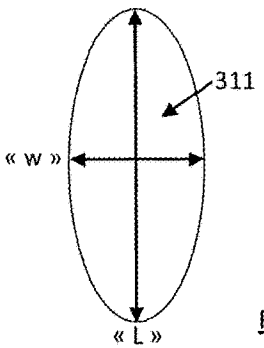
FIGS. 4*a* to 4*c* illustrate the heads of the pressure devices positioned on the thorax, the impact face of the pressure devices having an elongated shape.
Figure 4B:
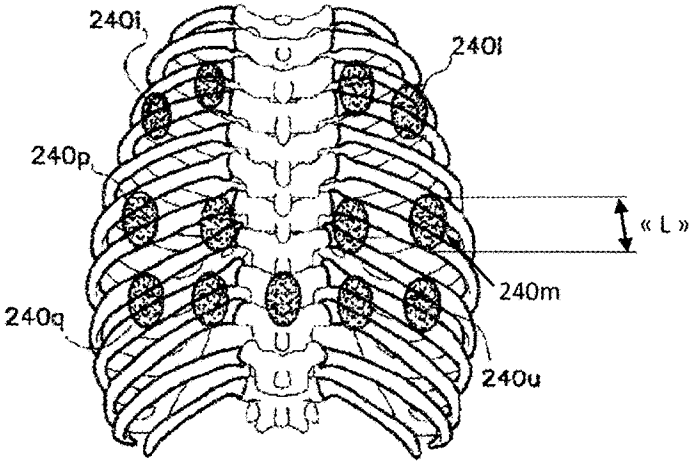
Figure 4C:
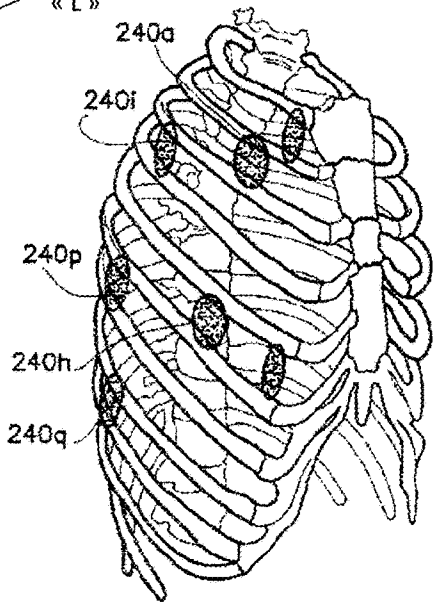
Figure 4A:
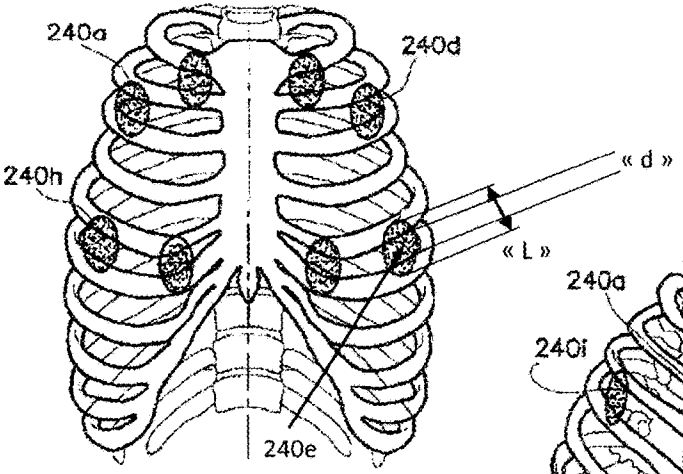

When the patient wears the medical vest 200, the first pair of support arms 261*a*, 261 *b* of the front frame 220 is arranged to substantially correspond to the first, second and third pairs of ribs or coastal bones. Each of the pressure devices 240 mounted on the first pair of support arms 261*a*, 261*b* gives pressure on two adjacent ribs, as illustrated in FIGS. 3*a* and 4*a*.

Preferably, the distal ends of the support arm 261*a*, 261*b* are shaped as rounded corners in order to avoid causing pain or discomfort for the patient.

The second support sub-frame 262 is composed of a second pair of support arms 262*a*, 262*b*. The function, structure, material and size of the second pair of support arms 262*a*, 262*b* are similar to those of the first pair of support arms 261*a*, 261*b*; for this reason, a detailed description of the function, structure, material and size of the second pair of support arms 262*a*, 262*b* will be omitted in order to avoid redundancy.

When the medical vest 200 is worn on the patient, the two support arms 262*a*, 262*b* longitudinally extend in a downward direction substantially perpendicular to the direction 211 along which the pressure devices 240 retracts and form a downward and inner angle $\alpha 2$. The range of the angle $\alpha 2$ is, $100° \leq \alpha 2 \leq 180°$, but not limited thereto. Moreover, the inner angle $\alpha 2$ can be different from or identical to the inner angle $\alpha 1$ of the first pair of the support arms 261*a*, 261*b*. In the present embodiment, the inner angle $\alpha 2$ is 180°, different from the inner angle $\alpha 1$ which is 150°.

In the present embodiment, the intersection of the second support sub-frame 262 and the front vertical axis 251 is at the lower end of the vertical axis 251 corresponding to the lower end of the rib cage of the patient.

When the patient wears the medical vest 200, the second pair of support arms 262*a*, 262*b* of the front frame 220 is arranged to be substantially correspond to the fifth and the sixth pairs of ribs. Each of the pressure devices 240 mounted on the second pair of support arms 262*a*, 262*b* gives pressure on two adjacent ribs, as it will be detailed below and as it is illustrated in FIGS. 3*a* and 4*a*.

The binding support 251 is a front vertical axis arranged to link the first support sub-frame 261 and the second support sub-frame 262, in order to support and maintain the front frame 220 and its support sub-frames 261, 262 in their correct positions.

In the embodiment depicted on FIG. 2*a*, the frame also comprises two additional binding supports 251', 251" located on both sides of the binding support 251. Each additional binding support 251', 251" extends parallel the binding support 251. Each support sub-frame 262 is linked to the binding support 251 and to one of the additional binding support 251', 251".

According to another embodiment, the front frame comprises only one binding support 251 that is preferably arranged to be the central axis of the front frame in parallel with the spine of the patient.

Such an embodiment is shown for instance on FIG. 1*a* for small sizes.

While the described and depicted embodiments provide very efficient results, it should be noted that the invention is not limited to the number and/or the position of the binding support 251 and/or the support sub-frames 261, 262 of the front frame 220. For example, in another embodiment of the invention, the medical vest 200 comprises two or three binding supports linking between the two support sub-frames 261, 262 so that the front frame 220 can comply better to the shape of the front side of the patient's trunk and also to prevent the support sub-frames 261, 262 from being twisted. Moreover, in another embodiment, the medical vest 200 may comprise more or less support sub-frames or support arms being arranged to accommodate the front frame 220 with an arrangement of the pressure devices 240 different from the above arrangement, for example in order to give pressure to different regions of the body of the patient. This also may depend on, for instance, the size or the shape of the support sub-frames or the support arms of the front frame 220.

According to a preferred embodiment, the front frame 220 and its support sub-frames 261, 262 are formed in a single piece. The single piece is made of a flexible material. Therefore, the frame forms a plate with possibly openings or holes. The single piece has a high tenacity, such as the plastic VIVAC. The single-piece front frame 220 can thus be sufficiently rigid to insure resistance to give a continuous support and prevent itself from being rotated or twisted. More precisely, the single-piece front frame 220 provides a continuous support to the pressure devices 240 and keeps the pressure devices 240 properly orientated at a 90 degree angle to the thorax of the patient in order to give the pressure substantially perpendicular. Furthermore, the flexibility of said material allows the single-piece front frame 220 to be still sufficiently flexible to comply with the shape of each individual patient's thorax. The thickness of the single-piece front frame 220 is comprised between 0.8 and 1.5 mm, preferably 1 mm. The frame is therefore light, bendable to fit the shape of the thorax while being sufficiently rigid to prevent or limit the torsion of the strips formed by the support sub frames fixed to the pressure devices.

The front frame 220 and its support sub-frames 261, 262 is designed for directly directing the therapeutic pulsations provided by the pressure devices 240 to the most important and efficient areas of the thorax of a patient. The medical vest 200 when held against the body will provide even homogeneous resistance to the pressure devices 240 two-way movement focusing a greater percentage of the energy transfer onto the thorax therefore increasing the therapeutic efficiency.

Rear Frame

The rear frame 230 comprises a rear vertical axis 252, a plurality of support sub-frames 263, 264, 265, and a plurality of pressure devices 240.

As shown on FIG. 2*a*, a third support sub-frame 263, a fourth support sub-frame 264 and a fifth support sub-frame 265 are configured to accommodate and fix the positions of the plurality of pressure devices 240 and to comply with a shape of the back side of the patient's trunk without being rotated or twisted along a transversal axis substantially parallel to surface of the back of the patient and perpendicular to the spinal column.

The function, structure, material and size of the support sub-frames 263, 264, 265 of the rear frame 230 are similar to the support sub-frames 261, 262 of the front frame 220. For this reason, a detailed description of the function, structure, material and size of the support sub-frames 263, 264, 265 will be omitted in order to avoid redundancy.

According to the preferred embodiment illustrated on FIG. 2*a*, the support sub-frames 263, 264, 265 are respectively composed by a third pair of support arms 263*a*, 263*b*, a fourth pair of support arms 264*a*, 264*b* and a fifth pair of support arms 265*a*, 265*b*. When the medical vest 200 is worn on the patient, the third pair of support arms 263*a*, 263*b*, the fourth pair of support arms 264*a*, 264*b* and the fifth pair of support arms 265*a*, 265*b* form respectively three downward and inner angles $\alpha 3$, $\alpha 4$ and $\alpha 5$. The preferably range of each of the angle $\alpha 3$, $\alpha 4$, as is, $100° \leq \alpha 3, \alpha 4, \alpha 5 \leq 180°$, but not limited thereto. Moreover, the inner angles $\alpha 3$, $\alpha 4$, $\alpha 5$ can be different from or identical to each other. In the present embodiment, the inner angle $\alpha 3$ is 150°, and the inner angles $\alpha 4$ and $\alpha 5$ are both 180°.

Two proximal ends of the two support arms 263*a*, 263*b* are coupled to the upper end of the vertical axis 252. Two proximal ends of the two support arms 264*a*, 264*b* are coupled to the middle section of the vertical axis 252. Two proximal ends of the two support arms 265*a*, 265*b* are coupled to the lower end of the vertical axis 252.

Preferably, when the patient wears the medical vest 200, the third, the fourth and the fifth pairs of support arms of the rear frame 230 are respectively arranged to be positioned substantially onto the third and the fourth, the sixth to the eighth, and the eighth to tenth pairs of ribs. Each of the pressure devices 240 mounted on the third, the fourth and the fifth pairs of support arms of the rear frame 230 respectively gives pressure on two adjacent ribs, as illustrated in FIGS. 3*a* and 4*a*.

It should be noted that in this present embodiment, the fourth and the fifth support sub-frames 264, 265 of the rear frame 230 are arranged to be directly onto the lower lobes around the side and lower back of the patient. And yet it has been found that these areas are often the most problematical for secretion pooling, mucus plugging and infections. Thus, the structure of the rear frame 230, especially the fourth and the fifth support sub-frames 264, 265, makes treating these areas very important and according to clinical input will greatly improve the therapeutic results.

It should be noted that the implementation of the support sub-frames 263, 264, 265 are not limited to the above preferred embodiment. For example, the support sub-frames 263, 264, 265 can be made with a single piece of an arc shape.

The rear vertical axis 252 is a binding support 252 arranged to be link between the support sub-frames 263, 264 and 265, in order to support and maintain the rear frame 230 and its support sub-frames 263, 264, 265 in their correct positions. In the present embodiment, the vertical axis 252 is the only one binding support of the rear frame 230 and is preferably arranged to be a central axis of the rear frame 230 in parallel with the spine of the patient.

While the described and depicted embodiments provide very efficient results, it should be noted that the invention is not limited to the number and/or the position of the binding support 252 and/or the support sub-frames 263, 264, 265 of the rear frame 230. For example, in another embodiment of the invention, the medical vest 200 comprises more or less support sub-frames or the support arms being arranged to accommodate the rear frame 230 with an arrangement of the pressure devices 240 different from the above arrangement, in order to give pressure to for example different regions of the body of the patient. This also may depend on, for instance, the size or the shape of the support sub-frames or the support arms of the front frame 230.

Similar to the front frame 220, the rear frame 230 and its support sub-frames 263, 264, 265 are formed in a single piece in order to provide a continuous support to the pressure devices 240 and keep the pressure devices 240 properly orientated at a 90 degree angle to the thorax of the patient.

One preferred embodiment of the arrangement of the pressure devices 240 is illustrated on FIGS. 1 and 2*a*. n is an integer and presents a number of pressure devices 240 mounted on a support sub-frame (i.e. support sub-frames 261-265 on FIG. 2*a*). The n pressure devices 240 do not overlap with each other and are evenly distributed on said support sub-frame. The number n depends on the size of the pressure device 240 and that of the support sub-frame.

When n is odd, one pressure device 240 is mounted on an intersection of the vertical axis (251, 252) and said support sub-frame. (n−1)/2 pressure devices 240 are mounted on each support arm of said support sub-frame. When n is even, n/2 pressure devices 240 are mounted on each support arm of said support sub-frame.

For example, the support sub-frame 262 of the front frame 220 illustrated on FIG. 2*a* accommodates four pressure devices 240*e*-240*h*, among which two are mounted on the support arm 262*a* and two others are mounted on the support arm 262*b*. There is no pressure device 240 mounted on the intersection of the vertical axis 251 and the support sub-frame 262.

The support sub-frame 265 of the rear frame 230 accommodates five pressure devices 240*q*-240*u*, among which the pressure device 240*s* is mounted on the intersection of the vertical axis 252 and the support sub-frame 265, two are mounted on the support arm 265*a*, and the other two are mounted on the support arm 265*b*.

It should be noted that the invention refers, but is not limited to the above arrangement of the pressure devices 240. The arrangement of the pressure devices 240 can be different from the above example, depending on the structure of the elements of the front frame 220 and/or the rear frame 230. Other arrangements of the pressure devices 240 can be applied without departing from the scope of the present invention.

Shroud

According to a preferred but not limitative embodiment, the vest comprises a shroud that surrounds the thorax and that consequently surrounds the frame and the pressure device fixed to the frame when the medical vest is worn. Therefore, the outer face 232 of the frame is in regard with an inner face of the shroud.

The shroud is elastic. It is arranged to compress preferably the front frame 230 and the rear frame 230 against the thorax. Consequently the shroud presses the pressure devices against the thorax.

Preferably, the elastic shroud is configured so that the plurality of pressure devices 240 is tight against the thorax with an even distribution of pressure around the entire circumference of the thorax.

The elastic shroud also allows firmly maintaining the pressure device between the thorax and the inner face of the frame. Therefore, the elastic shroud reduces the movement between the pressure device and the frame. Thus, the elastic shroud helps maintaining the pressure device in their correct position. The pressure device remains perpendicular to the thorax and transfers a maximum of energy to the rib cage which allows maintaining a very high efficiency.

Preferably, the shroud comprises fastening means to be fastened to the frame holding the pressure devices.

According to a preferred embodiment, the shroud comprises at least a pocket configured to house at least a part of the frame and pressure device so that the frame and pressure device can be held when the shroud is worn on the thorax.

Preferably, the shroud comprises at least a pocket on the front side to house the front frame and at least a pocket on the rear side to house the rear frame.

Preferably, the shroud forms the most outer layer of the medical vest.

According to a first preferred embodiment, the shroud forms a jacket. It presents holes for passing shoulders or arms. It comprises elastic portions fixed on non-elastic portions. Preferably, the elastic portions are arranged to be located on the side of the thorax, below the holes for the shoulders or the arms. For instance, there are two elastic portions, each portion being located at one side of the jacket and positioned below a hole.

The jacket may also comprise elastic portions located over the shoulders and configured to pull the lines of pressure devices firm against thorax, preventing thereby that the lines of pressure device slid downward.

The jacket also comprises an opening for facilitating its positioning on the thorax. The elastic parts tend to pull the front and the rear part of the jacket against the thorax.

Figure 2C:
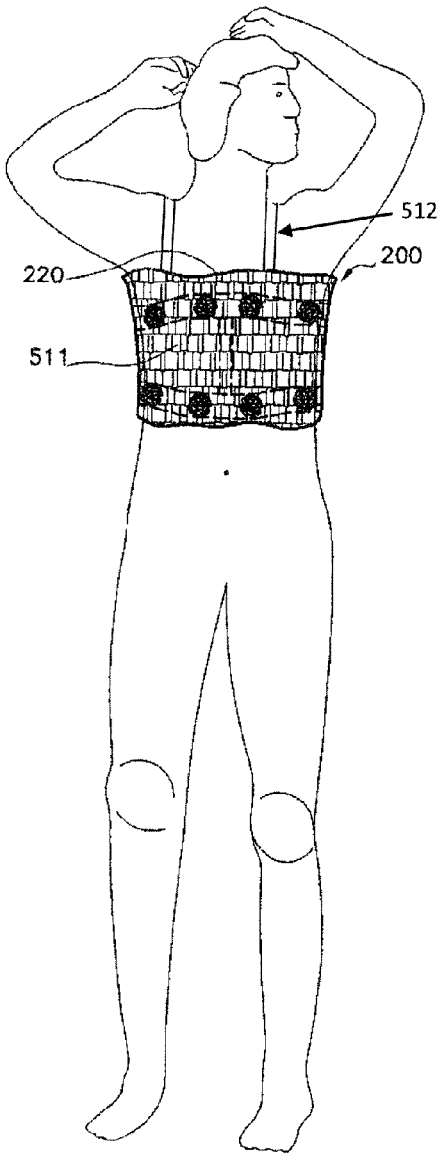
FIG. 2*c* illustrates a front view of a patient wearing another embodiment of a medical vest of the invention, said embodiment comprising an elasticated wrap.

According to a second preferred embodiment, the shroud forms a wrap 511. Such an elastics wrap is depicted on FIG. 2*c*. The wrap 511 is arranged to be positioned below the shoulders, for instance immediately below the armpits. The wrap 511 forms a sleeve that presses the frame and therefore the pressure devices against the thorax.

The wrap 511 may be entirely elastic. According to a more cost efficient embodiment, the wrap is made of a strip presenting elastic and non-elastic portions. The wrap is arranged so that when it is worn, the elastic portions are located at least on both sides of the thorax below the shoulders. Preferably, the part of the wrap designed to be located on the front or rear side of the thorax are not elastic.

The wrap also comprises an opening for facilitating its positioning on the thorax.

The elastic parts tend to press the front and the rear part of the jacket against the thorax.

The opening of the jacket or the wrap can be closed through a zip, clips or buttons or preferably hook-and-loop fastener such as Velcro®.

The elastic shroud, either a jacket or a wrap provides a homogeneous distribution of pressure around the entire circumference of the thorax which makes more homogeneous the repetitive compressions or focused pulsations applied by the pressure devices against the thorax. This significantly increases the whole efficiency of the system.

Preferably the wrap comprises elastic portions, such as braces 512 that are configured to be disposed over the shoulders to pull upper piston lines firm against thorax.

Therefore, the front frame 220 and the rear frame 230 of the medical vest 200 increases energy transfer by reducing the lost energy by keeping the pressure devices 240 substantially perpendicular to the patient's thorax.

Impact Face

According to an advantageous but not limitative embodiment of the invention, the head 303 of the pressure device comprises an impact face 311 which acts as an impact portion configured to strike the thorax or the layers disposed between the pressure device and the skin of the thorax. This outer surface is configured to apply on at least two adjacent ribs whatever is its position.

Figure 3C:
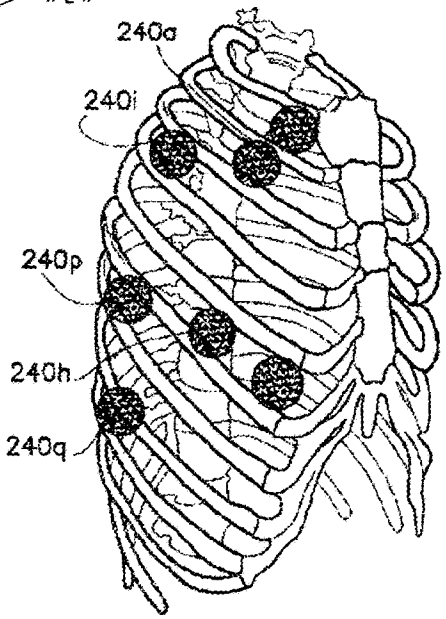
Figure 3B:
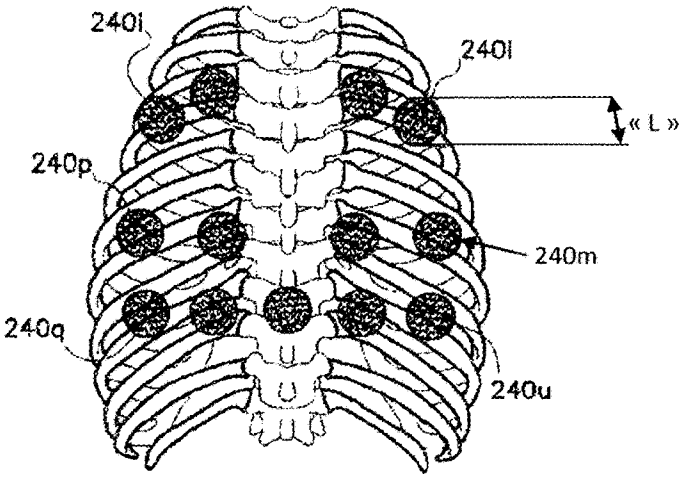

This is clearly illustrated in FIGS. 3*a* to 3*c* where the impact face 311 of the head 303 of each pressure device is depicted by a dark circle (240*a* . . . ). This is also clearly illustrated in FIGS. 4*a* to 4*c* where the impact face 311 of the head 303 of each pressure device is depicted by a dark oval shape (240*a* . . . ).

The length of the outer surface, according to a direction parallel to the spinal column, is longer than the average distance 'd' between two ribs adjacently disposed according to a direction parallel to the spinal column. The distance 'd' is illustrated in FIGS. 3*a* and 4*a*. Preferably, the length of the outer surface is longer than the average distance between three adjacent ribs.

During the development of the present invention, it was identified that the pressure device may tend to move from its ideal position where it operates forth and back movements along an axis that is perpendicular to the surface of the thorax that it compresses. The pressure device may thus tend to be inclined from this perpendicular position. More precisely, the head 303 of the pressure device may tend to slip and twist around a rib so that it applies its pressure on only one rib and possibly intercostal muscles. It was also found that the efficiency of the treatment may be significantly reduced if some of the pressure devices move from their ideal perpendicular position. Indeed, the transfer of energy is greatly reduced if the individual pressures generated by the pressure devices are not each transferred perpendicularly to the thorax. Since the invention allows the head 303 to apply on at least two ribs, the stability of the impact face 311 of the head 303 is significantly increased. Thus, the impact face 311 of the pressure device does not slip or twist around a rib but remains in firm contact with at least two ribs. The impact face 311 of the pressure device thus stays parallel to the thorax and the stroke generated by the pressure device is applied perpendicularly to the thorax.

In addition, it has been found that when the head 303 of the pressure device contacts intercostal muscles instead of contacting only one or several ribs, a part of the energy generated by the pressure device is actually transferred to the intercostal muscles which absorbs this energy without transferring it to the rib cage. A fewer energy is therefore transferred to the rib cage to vibrate the lungs. The treatment is consequently much less efficient. Instead, the invention prevents the head 303 of the pressure device from twisting and applying on the intercostal muscles. Therefore, the invention allows enhancing the efficiency of the treatment or allows reducing the compressions applied to the thorax for an efficiency equivalent to the one of the know systems which greatly reduces the pain of the patient during the treatment.

Preferably, the dimension of the impact face 311 of the head 303, taken in a direction that is substantially parallel to the spinal column of the patient, is comprised between 3 cm and 8 cm. This dimension is noted with the reference sign 1' in FIGS. 3*a*, 3*b*, 4*a*, 4*b* and 4*d*. The length of the impact face is preferably measured along a substantially vertical direction.

Preferably, the head 303 of the pressure device presents an impact face 311 that has an elongated shape. The head 303 is not circular, at least at its impact face 311. Such a pressure device is illustrated on FIGS. 4*a* to 4*d*. The elongated shape is taken in a section that is perpendicular to the main direction along which the pressure device expands i.e., the elongated shape is taken in a plane that is substantially parallel to the area of the thorax that is compressed by the head 303 of the pressure device. An exemplary embodiment of this section is depicted on FIG. 4*d*.

The elongated shape presents a length 1' and a width 'w', the vest being configured so that during the operation, the length extends substantially perpendicularly to the ribs on which the head 303 applies. The width 'w' of the impact face 311 of the head 303 extends perpendicularly to the length. Thus in operation the length extends substantially parallel to the spinal column, also called vertebral column.

Advantageously, this ensures that the pressure device is always in contact with two ribs while reducing the surface of the head 303 compared to a circular shape having a diameter of the size of the length 'L'. Therefore, the size and the volume of the pressure device are reduced. The volume of air required to move the head 303 of the pressure device is therefore reduced with the embodiment of the invention while maintaining a constant efficiency of the treatment. Therefore, the flow of air is also reduced in the vest. The operation of the vest is consequently less costly and much less noisy while preserving the efficiency of the treatment. Indeed, when developing the present invention it has turned out that the efficiency of the treatment is maintained if the surface of the head 303 of the pressure device is reduced, provided the impact face 311 of the pressure device transfers its energy on ribs only and not on the intercostal muscles.

According to an exemplary embodiment, the length of the impact face 311 of the head 303 extends perpendicularly to its width and the length is greater than 1.5 times the width. Preferably, the length is greater than 2 times the width. Preferably, the length is greater than 3 times the width. Preferably, the length is comprised between 1.5 and 5 times the width. Preferably, the length is comprised between 3 cm and 8 cm and the width is comprised between 1 cm and 4 cm.

Preferably, the impact face 311 of the head 303 is oval. It presents an ellipsoidal shape in a plane parallel to the surface where it is supposed to stroke the thorax. This allows homogenizing the transfer of energy from the pressure device to the thorax. According to another embodiment, the impact face 311 of the head 303 is rectangular.

Preferably, the impact face 311 of the head 303 is flat. According to another embodiment, the impact face 311 is convex or concave.

Distribution of the Pressure Devices

FIGS. 3*a* to 4*c* show the relative positions of the impact portion of the pressure devices and the ribs.

FIG. 3*a* illustrates one mapping between the pressure devices 240*a*-240*h* mounted on the front frame 220 and the positions of the ribs of the front side of the thorax impacted by the pressure devices 240*a*-240*h*. FIG. 3*b* illustrates one mapping between the pressure devices 240*i*-240*u* mounted on the rear frame 230 and the positions of the ribs of the rear side of the thorax impacted by the pressure devices 240*i*-240*u*. FIG. 3*c* illustrates the pressure devices 240*a*-240*u* utilized for giving pressure to the ribs of the thorax according to a side view.

As illustrated on the FIGS. 3*a* to 3*b* each of the pressure devices 240*a*-240*u* gives pressure on two adjacent ribs. An impact surface of a pressure device 240 has a round shape.

FIG. 4*a* illustrates one mapping between the pressure devices 240*a*-240*h* mounted on the front frame 220 and the positions of the ribs of the front side of the thorax impacted by the pressure devices 240*a*-240*h*. FIG. 4*b* illustrates one mapping between the pressure devices 240*i*-240*u* mounted on the rear frame 230 and the positions of the ribs of the rear side of the thorax impacted by the pressure devices 240*i*-240*u*. FIG. 4*c* illustrates the pressure devices 240*a*-240*u* utilized for giving pressure to the ribs of the thorax according to a side view.

As illustrated on the FIGS. 4*a* to 4*c*, each of the pressure devices 240*a*-240*u* gives pressure on two adjacent ribs. An impact surface of a pressure device 240 has an oval shape.

Pressure Device

Preferred but not limitative embodiments of the pressure devices 240 according to the invention will be now described in reference to FIGS. 5 to 10. All the features of the embodiments that will be described below with reference to FIGS. 5 to 9 can be combined to pressure devices having an elongated outer surface as described above. The plurality of pressure devices 240 is utilized for giving a pressure substantially perpendicular to the thorax of the patient.

The pressure device 240 comprises a chamber 308 that is sealed. At least, an opening 307, also referred to as an air inlet, allows feeding the chamber with pressurized fluid. The chamber 308 is delimited by walls of a head 303, a body 302 and a base 304.

The body 302 extends between the head 303 and the base 304.

The head 303 is configured to be, in use, turned toward the patient's body.

Preferably an external wall of the head, which is preferably flat, is intended to stroke the patient's body. As indicated above, this surface is referred to as the impact face 311 of the head or the impact portion.

The base 304 comprises at least a port 305, 306 for establishing a communication between the chamber 308 and its opening(s) 307 and an air supply. In the illustrated embodiment, the base 304 comprises a first port 305 in communication with the pressurized air supply, typically the pump 330. The base also comprises an additional port 306 for communication with the exterior of the medical vest 200. Typically, the additional port 306 is in communication with the air at room pressure.

Figure 6:
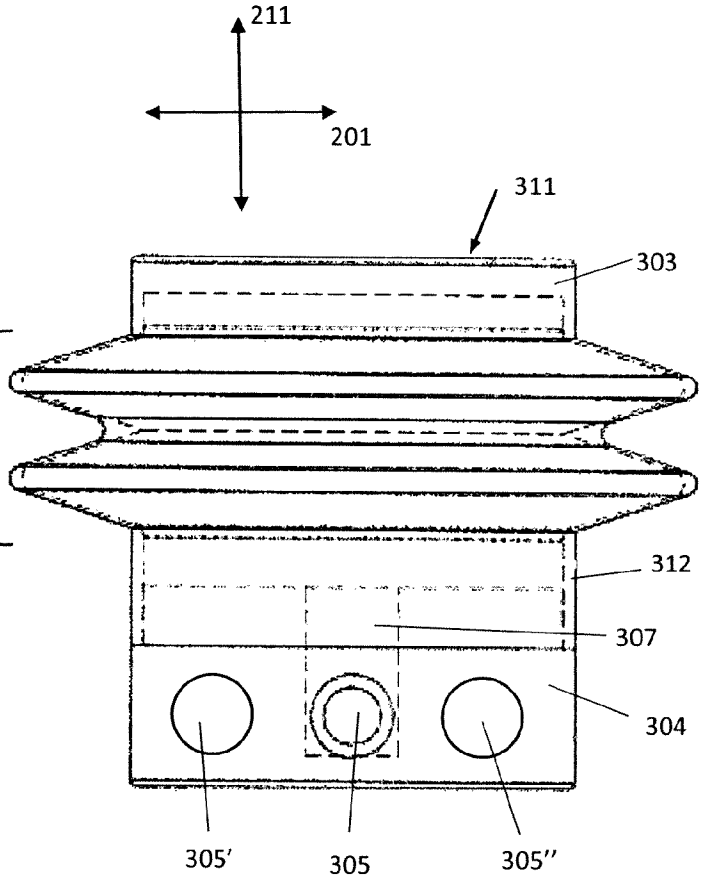
FIG. 6 is a side view of the pressure device according to FIG. 2*a*.
Figure 5:
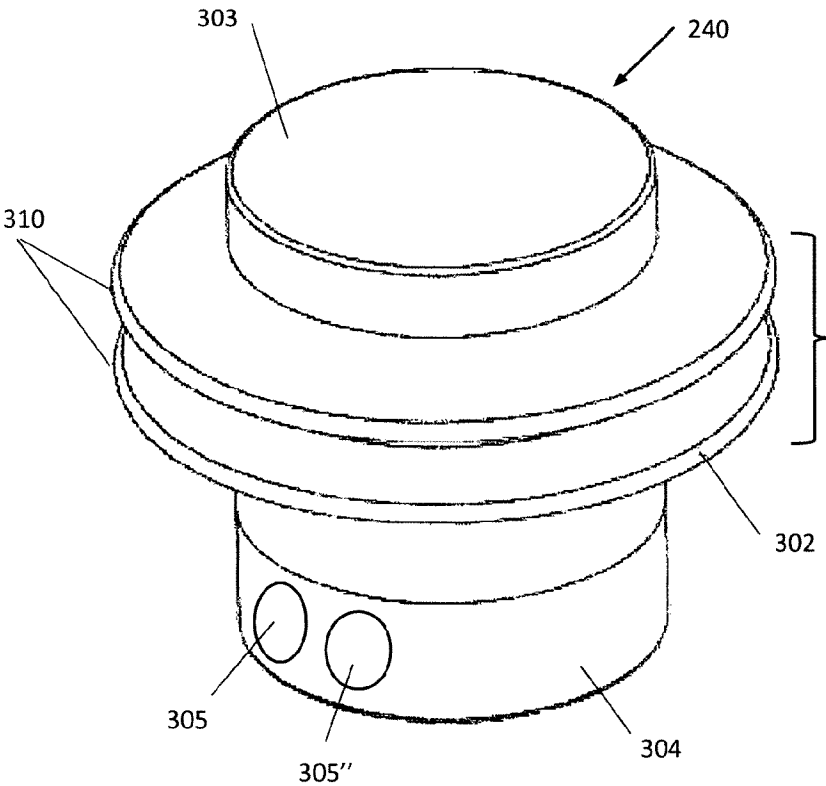
FIG. 5 shows a perspective view of an example of the pressure device according to an embodiment of the invention.

According to a first embodiment, the pressure device only comprises two ports 305, 306. The port 305 is depicted in FIGS. 5 and 6.

According to another and preferred embodiment, the pressure device comprises four ports as illustrated in FIGS. 1, 2*a*. FIGS. 5 and 6 also show the ports 305' and 305". This embodiment with four ports will be described with further details below.

The ports of the base 304 are in communication with the chamber 308 through the opening(s) 307.

Typically, the base 304 presents a shape substantially cylindrical. The ports extend transversally/radially inside the base 304 from an external wall of the base 304. The opening 307 extends substantially longitudinally, from the ports to the upper wall 315 of the base 304. Said upper wall 315 of the base defines in part the chamber 308.

The body 302 is tightly sealed to the chamber 308 and to the head 303. Preferably the head 303 and the body 302 form a single, monolithic part.

Thus a distal end of the body 302 forms the head 303. A proximal end 312 of the body 302 is attached to the base 304.

Preferably, the base 304 presents at its distal end a cylindrical section 313 that is complementary of the section of the proximal end 312 of the body 302. Typically, the two sections 312, 313 are cylindrical and the inner diameter of the proximal end 312 of the body 302 fits the outer diameter of the distal end 313 of the base 304. There is therefore a tight fit between the body 302 and the base 304.

The body 302 and the base 304 are glued together ensuring a perfect pneumatic seal of the two parts at the pressure used during operation.

The chamber 308 is thus a sealed volume except through the openings 307, said volume being defined by the upper wall 315 of the base 304, the inner walls of the body 302 and the inner wall of the head 303.

When the pressure device 240 is fed with pressurized fluid, typically pressurized air, it inflates and is brought, from a deflated configuration to an inflated configuration.

The pressure device 240 comprises elastic means arranged so that when the pressure device 240 is not fed with pressurized air, the chamber 308 automatically retracts. The chamber 308 thus passes from an inflated configuration to deflated configuration.

The fluid supply, not detailed in the present invention but known from the person of ordinary skills, provides pulsed fluid under pressure. A particularly advantageous supply system is described in the commonly owned International patent application published with the following number WO2011086200. The supply of pulsed air generates cycles of inflations and deflations of the pressure device 240. Each inflation generates a stroke onto the patient's body.

The elastic means allow an acceleration of the movement from the inflated configuration to the deflated configuration through pulling back the head 303 toward the base 304, such as a return spring. In addition, the pressure device 240 is configured so that when passing from the pressure device 240 deflated configuration to the inflated configuration, the pressure device 240 expands substantially according to a single direction 200. This direction is the axial direction 211 along which the head 303 of the pressure device 240 performs forth and back movements. This axial direction is preferably substantially perpendicular to the area of the patient's body where the pressure device strokes or pulsations. Almost all the energy of the stroke is thus delivered to the patient's body, increasing thereby the efficiency of the treatment.

Therefore a relatively low volume of pressurized fluid is necessary to deliver efficient strokes. The overall energy provided to each pressure device 240, and consequently the overall energy provided to the vest, is thus decreased. Therefore, the overall trauma undergone by the patient is thus greatly reduced while generating controlled forces applied perpendicularly to the patient's body. This allows targeting clinically important areas of the patient's body. The medical vest 200 comprising such pressure devices 240 therefore permits the transformation of all or almost all the energy delivered to the medical vest 200 into focused and controlled strokes and pulsations. The overall action on the patient's body is thus much gentler and more precisely targeted than with previous systems.

In addition, the operation of the medical vest has no or has a low effect on the patient's blood pressure which allows hypertensive patients to use the vest.

Figure 7:
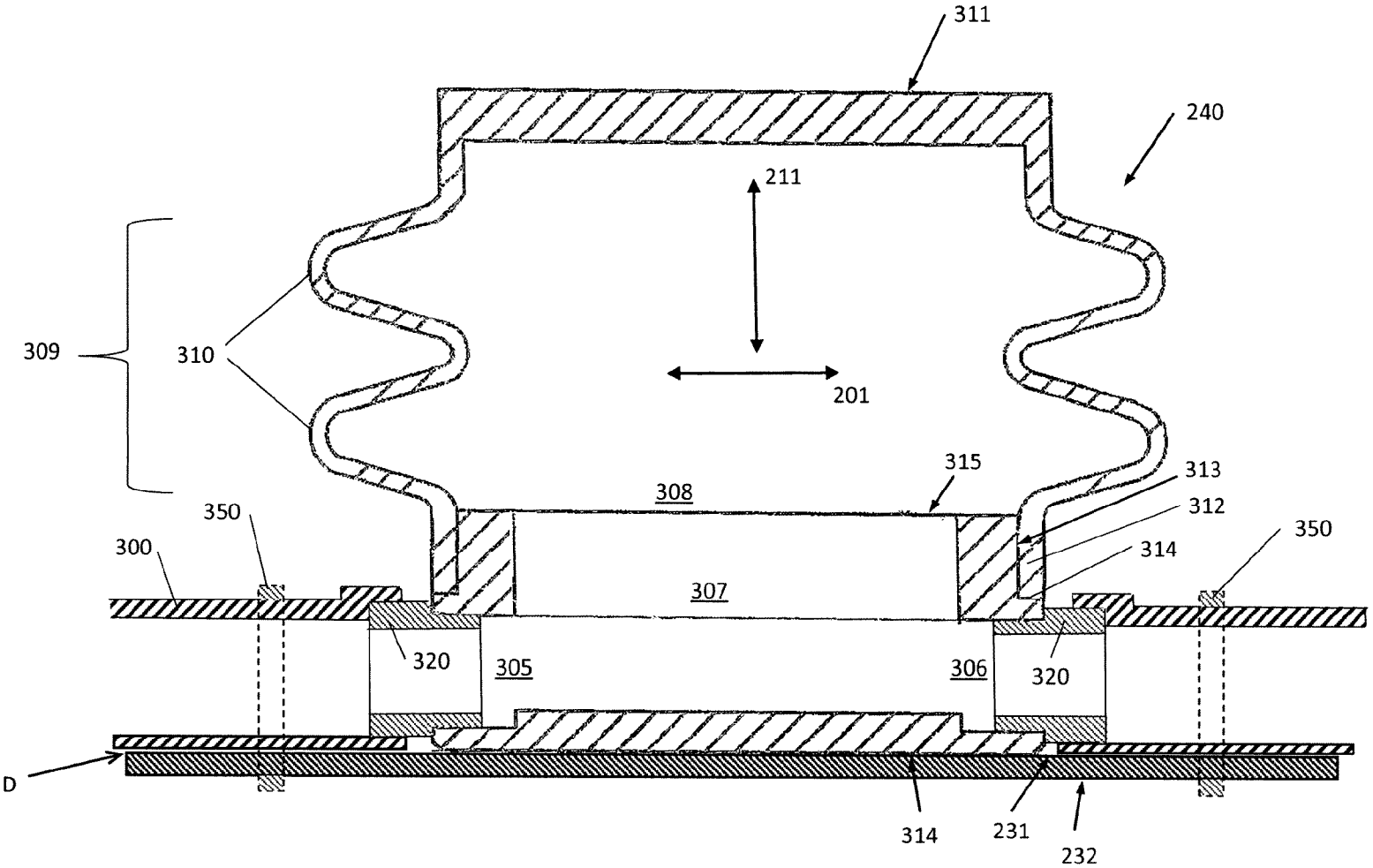
FIG. 7 is a cross sectional view of the pressure device according to FIG. 5 wherein the pressure device is fastened to a frame
Figure 8:
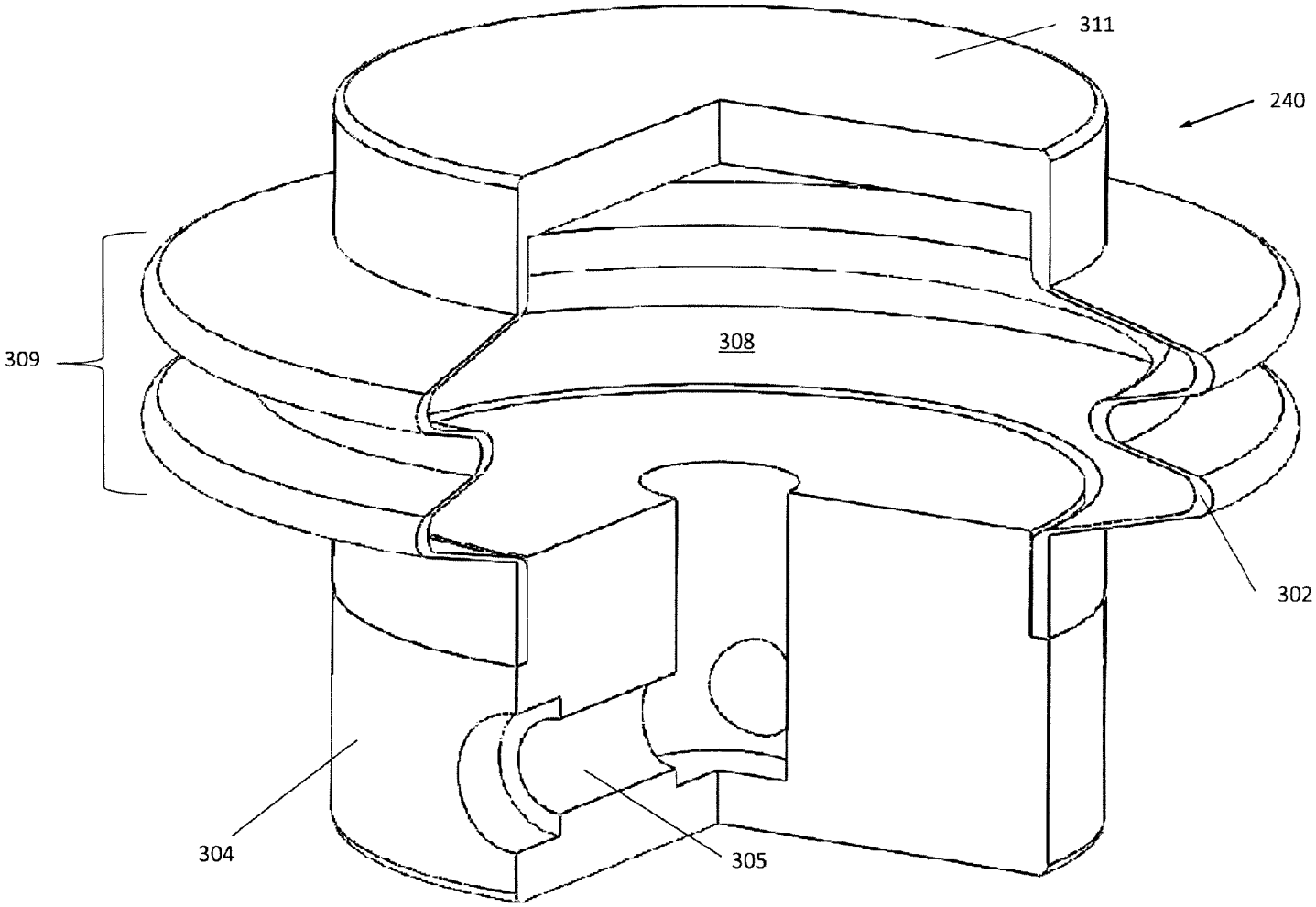
FIG. 8 is a perspective view, partly sectioned, of the pressure device according to FIG. 5 in a deflated configuration.
Figure 9:
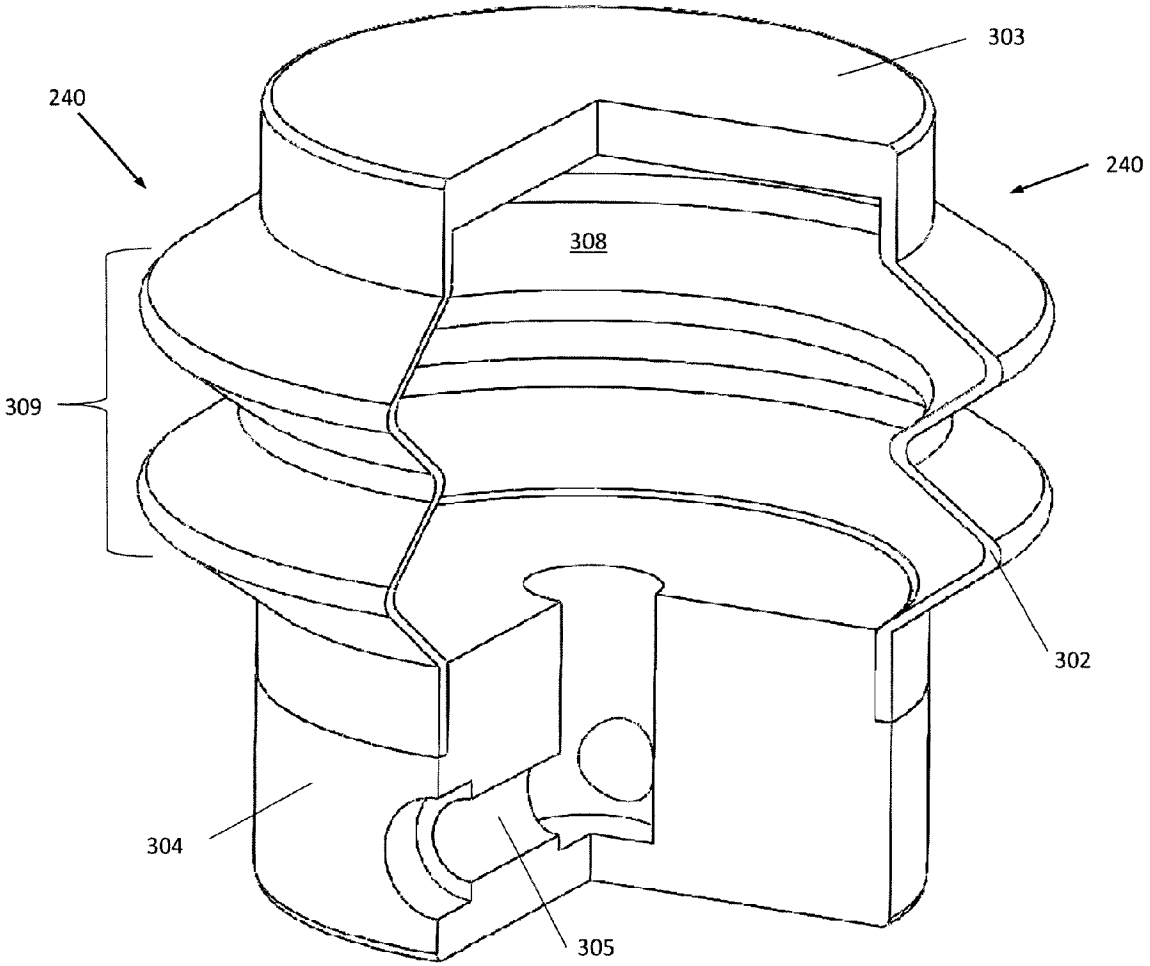
FIG. 9 is a perspective view, partly sectioned, of the pressure device according to FIG. 5 in an inflated configuration.

Preferably, the elastic means are comprised in bellows 309. Such bellows 309 are clearly illustrated on FIGS. 5 to 9. The bellows 309 retract when the pressure device 240 passes from the inflated to the deflated configurations and expand when the pressure devices passes from the deflated to the inflated configurations under the force of the pressure rising in the chamber 308. The bellows 309 tends to bring the pressure device 240 back to the deflated configuration. It acts as a return spring. FIGS. 8 and 9 respectively illustrate bellows 309 in their retracted and expanded positions.

The pressure device provides a higher reactivity compared to existing systems. It can efficiently operate in a wide range of frequencies, typically frequencies comprised between 10 and 40 Hz and preferably comprised between 10 Hz-30 Hz and preferably comprised between 15 Hz-30 Hz. HFCWO treatments can thus be adapted to every patients and medical situations.

Preferably, the bellows 309 comprise corrugations 310, or pleats 310 having substantially annular shapes. Thus the length of the body 302 increases along the axial direction 211 and the outer dimension, typically outer diameter, of the bellows 309, taken along the transverse direction, decreases when the pressure device 240 inflates. The length of the body 302 decreases along the axial direction 211 and the outer dimension of the bellows 309 increases when the pressure device 240 deflates.

The retracted position of the elastic means or bellows 309 is also a release position. However, the body 302 can be free then retracted or shrunken in case a force is applied on it. Typically, when the pressure device 240 is compressed between two walls of the medical vest 200 under the pressure of the patient's body (especially when the patient breaths), the bellows 309 can further retract. This increases the comfort of the patient when breathing for instance.

The head 303 is substantially non-deformable in regard to the deformation of the body 302. In particular, the outer surface of the head 311 does not inflate when the air pressure increases in the chamber 308. Thus the stroke, its amplitude and location are perfectly controlled. The head 303 and the body 302 are made of an elastic material, typically silicon for instance, but the thickness of the head 303 makes it non-deformable under the pressures utilized. The shape of body 302 makes it non-deformable on the transverse direction. More generally, the deformation of the head 303 and body 302 through elasticity is negligible in comparison to the deformation through the extension and retraction of the bellows 309.

Preferably, the base 304 is non-deformable through elasticity during use.

While being non-deformable through elasticity during forth and back movements of the head 303, the body 302 and base 304 are preferably ductile. This notably increases the comfort of the user.

Preferably, the head 303 and body 302 are made of silicon. Preferably, the base 304 is also made in silicon. This allows increasing the robustness of the pressure device and its ductility, providing thereby enhanced lifespan and comfort.

Preferably, the pressure device is made a single piece. This means that there is no part that moves against another part. In particular, there is no part that slides or rotates against another part. The structure of the pressure device allows significantly easing the assembly of the medical vest which reduces its cost.

Preferably, the variation of dimensions according to the axial direction 211 is higher than according to the transverse direction 201. Typically, the ratio 'transverse variation/axial variation' is lower than 0.8. Preferably, this ratio is lower than 0.4.

Typically, during the operation of the vest, the maximal pressure inside the piston is comprised between 100 millibars ($10^{-3}$ bars) and 350 millibars. Advantageously, during a whole cycle, the pressure device is momentarily deflated and its internal pressure is ambient pressure or is lower than 30 millibars. Very good results have been obtained for a maximal pressure comprised between 150 and 250 millibars inside the air piston. More precisely a pressure of 200 millibars provides very efficient results.

Typically, during the operation of the vest, the maximal pressure applied by the head of the pressure device onto the patient's body is comprised between 20 and 80 millibars. At each cycle, as the pressure device is deflated, the pressure applied onto the patient's body is practically nothing, and is more generally below 2 or 3 millibars. This allows the patient to breath during the treatment. Advantageously, as the pressure applied on the patient's body momentarily decreases to reach a pressure that is practically nothing or very low, then the treatment has no or very low effect on the patient's blood pressure. More precisely, during the operation of the vest, the maximal pressure applied by the head of the pressure device onto the patient's body is comprised between 40 millibars and 65 millibars and preferably comprised between 40 millibars and 60 millibars. Typically, this pressure is 50 millibars or 58 millibars.

Advantageously, the head of the pressure device has a thickness, according to the axial direction, that is comprised between 0.5 mm and 4 mm. During the development of the invention, it has turned out that a portion of the energy of each stroke is not transferred to the patient's body but is instead transformed into a rebound that the pressure device performs against the patient's body. The above values of thickness for the pressure device's head allow reduction of this rebound effect and produce more energy into the pulsation onto patient's thorax. Thus the energy transferred into the patient's body is increased, enhancing thereby the efficiency of the treatment. More precisely, the thickness of the head of the piston is comprised between 1 mm and 3 mm. Typically, for optimum effect this thickness is 2 mm. Very good results have been obtained for a silicon made head.

The pressure device 240 in its release configuration has a length, according to the axial direction 211, comprised between 30 and 60 mm (millimeters i.e, $10^{-3}$ meters) and preferably approximately 44 mm.

The amplitude of the pulsations generated by the a vest or a device according to the invention is several times greater than those created by existing devices which simply cut airflow into the vest causing a small dip in pressure to create the pulsations (from 58 mb down to 52 mb for the VEST) whereas the vest or the device according to the invention goes from 0 mb up to 58 mb thus giving us an amplitude of 58 mb−0 mb=58 mb, i.e., much greater than the amplitude created by the existing systems of roughly 58 mb−52 mb=6 mb amplitude pulsation. This leads to a significant increase in efficiency, creating a resonance inside the lungs, not simply a rush of air out of the lungs, creating thereby a shearing effect to pull mucus off the bronchial walls. The invention also allows creating the sheering effect and soliciting a cough much sooner than existing devices.

Fastening of the Pressure Device to the Frame

A solution for fastening the pressure devices 240 to the frame and for connecting the pressure devices 240 together will be now described, in reference to the embodiment illustrated in FIG. 2*a* ad 7.

pressure devices 240 pressure device 240 pressure device 240 pressure device 240 As indicated above, the medical vest comprises at least a frame 220, 230 for holding the pressure devices 240 substantially perpendicular to the thorax, an outer face 314 of the base being in contact with an inner face 231 of the frame. At least some of the pressure devices 240 are aligned. Two consecutive pressure devices 240 of a line are connected together by at least two tubes 300 as illustrated in FIG. 2*a*. Preferably, the distance between each tube 300 connecting two consecutives pressure devices 240 and the inner face 231 of the frame 200 is inferior to 8 mm.

This distance is measured perpendicularly to the inner face 231 of the frame. On FIG. 7, this distance is measured vertically. This distance is referenced "D" on this FIG. 7. On this figure, only one tube 300 can be seen on each part of the pressure device, the two additional tubes being hidden by the two tubes that are depicted. Thus, the two tubes 300 are very near the inner face 231 of the frame. Therefore, if a pressure device 240 tends to tilt from a position where it is perpendicular to the frame and the thorax, the tubes 300 generate an opposition force that maintains the pressure device 240 in its perpendicular position. The ideal position of the pressure device is clearly depicted on FIG. 7 and corresponds to a situation where the axis 211 is perpendicular to the inner face 231 of the frame and to the portion of surface of the thorax that the pressure device is supposed to hit.

During the achievement of the present invention it has turned out that without the present invention the pressure devices 240 often tend to incline from their position where there are perpendicular to the frame and the thorax. In addition, it has been identified that even if the pressure device 240 are slightly tilted from their perpendicular position, only a very small amount of the energy of the compression is actually transferred to the thorax. Therefore, the efficiency of the all treatment is greatly reduced.

Therefore, by limiting the inclination of the pressure device 240 around a position wherein its base is firmly in contact with the inner face 231 of the frame, the invention allows maintaining the pressure device 240 in the correct position and enhances the efficiency of the treatment. This increased efficiency is obtained while reducing significantly the complexity of the assembly. Indeed, the pressure devices 240 do not need to be each inserted in housing to maintain them. The time required to assemble the vest and the cost are therefore greatly reduced.

The medical vest is configured so that, at least when a pressure device 240 tends to incline from a position wherein it is perpendicular to the frame and the thorax, at least a tube 300 comes into contact with the inner face 231 of the frame 200 and thereby stops any further displacement of the pressure device.

Preferably, at least a tube 300 comprises an outer airtight envelope and a reinforcement structure housed inside the envelope. This allows enhancing the rigidity of the assembly comprising the pressure device 240 and the tubes 300, preventing thereby any rotation of the pressure devices 240 around an axis substantially perpendicular to the tubes 300 connecting that pressure device.

Preferably, the tubes 300 are connected to the pressure device 240 via a holder 320 that is inserted in both the port of the pressure device and the end of the tube, said insertion being airtight. An example of holders is illustrated in FIG. 7.

Preferably, the distance between each tube 300 connecting two consecutives pressure devices 240 and the inner face 231 of the frame 200 is inferior to 6 mm. Preferably, the distance between each tube 300 connecting two consecutives pressure devices 240 and the inner face 231 of the frame 200 is comprised between 0 and 4 mm and preferably between 0 and 3 mm. Preferably, the tubes 300 are in contact with the inner face 231 of the frame.

The two tubes 300 connecting two consecutives pressure devices 240 are comprised in a plane that is substantially parallel to the inner face 231 of the frame. The two tubes 300 connecting two consecutives pressure devices 240 are parallel to each other. They form a line or a curve. They extend substantially linearly and form together an angle comprised between 0 and 30 degrees and preferably between 0 and 15 degrees.

Advantageously, more than half and preferably more than ⅔ of the surface of the outer face 314 of the base is in contact with the inner face 231 of the frame. Preferably the outer face 314 of the base is flat. Preferably, the entire surface of the outer face 314 of the base is in contact with the inner face 231 of the frame. Therefore, the reaction strength that the thorax applies against the pressure device 240 and that tends to push back the pressure device 240 towards the inner face 231 of the frame 200 is transferred to the inner face 231 of the frame 200 by a large surface. Therefore the pressure between the pressure device 240 and the inner face 231 of the frame 200 is limited. The deformation of the frame is thus limited. The pressure devices 240 are therefore firmly maintained in their correct position perpendicular to the chest. In addition, the wear of the frame is limited and its lifespan is increased.

At least three pressure devices 240 form a line of pressure devices 240, at least two of these pressure devices 240 comprising each four ports. Typically, for adults, a line of pressure devices comprises 2 to 6 pressure devices. For infant, a line comprises 2 or 3 pressure devices.

Preferably, each port is permanently open. They always allow the passage of air in or out the chamber. These ports do not contain any valve. They are never blocked. They do not interrupt the flow of air.

According to an advantageous embodiment, illustrated in FIG. 2*a* (not all reference signs are indicated in FIG. 2*a* for sake of clarity) for each pressure device 240, such as the pressure device 240*g*, comprising four ports,

- one first port 241*g* is an inlet port for letting the pressurized fluid flow into the chamber when the pressure is rising, the pressurized fluid coming from upstream when the pressure is rising. When the pressure is rising the pressurized fluid flows from pressure device 240*f* to pressure device 240*g*.
- one second port 242*g* is an outlet port for letting the pressurized fluid flow out of the chamber and towards a pressure device 240*h* located in the line and downstream when the pressure is rising,
- one third port 244*g* is an inlet port for letting the pressurized fluid that is coming from upstream (i.e., from pressure device 240*h*) when the pressure is decreasing flow into the chamber when the pressure is decreasing,
- one fourth port 243*g* is an outlet port for letting the pressurized fluid flow out of the chamber and towards a pressure device 240*f* located in the line and downstream when the pressure is decreasing.

The first 241*g* and third 244*g* ports are connected to a pressure device 240*h* of the line and the second 242*g* and fourth 243*g* ports are connected to another pressure device 240*f* of the line.

Preferably, the tubes 300 connected to the first and third ports are parallel and form together an angle comprised between 0 and 15 degrees and the tubes connected to the second and fourth ports are parallel and form together an angle comprised between 0 and 15 degrees.

The tubes connected to the first and second ports are aligned and the tubes connected to the third and fourth ports are also aligned.

The pressure device 240*e*, 240*d* located at a proximal end of a line is connected to a tube 301 in communication with an air supply. These pressure devices 240*e*, 240*d* are also connected to a tube 301' that allows evacuating the air out of the line of pressure devices once the pressure devices are intended to deflate. The pressure device 240*h*, 240*a* located at a distal end of a line comprises only two ports, one port being connected to a tube that supplies the chamber with pressurized air and one port connected to a tube for letting the air evacuate the chamber.

According to an advantageous embodiment, the medical vest comprises at least a fastener that fastens the frame to the pressure device 240 and/or at least a fastener 350 that fastens the frame to at least a tube.

Preferably, at least a fastener 350 fastens the frame to two tubes 300 connecting two consecutives pressure devices 240. This embodiment is illustrated in FIG. 7 and in FIG. 2*a* where the fasteners 350 are shown only for the upper line of pressure devices 240 of the front frame 220.

Advantageously, this allows preventing any rotation of the pressure device 240 according to a direction that is substantially parallel to the tubes 300 connecting that pressure device.

Preferably, the fastener 350 surrounds and clasps the two tubes 300 and the frame. This enables assembling the medical vest very easily. Preferably, the fastener 350 is a cable tie, also called zip tie or tie-wrap. Advantageously, this allows facilitating the fastening of the tubes 300 and the pressure device 240 on the frame. In addition, this allows limiting the cost of the vest.

The frame comprises at least a recess 340 or at least a hole through which passes the zip tie so that the zip tie does not slide along a direction that is parallel to the tubes 300 i.e., parallel to the direction in which the support sub-frame extends.

Therefore, the whole line of pressure device 240 and tubes 300 is firmly hold against the inner face 231 of the frame 200 and cannot slide on it.

The invention also relates to a method for fabricating a medical vest. The method comprises the following steps:

- a step of forming a line of pressure devices 240, this step comprising connecting a plurality of pressure devices 240 with tubes 300,
- disposing the line of pressure devices 240 on the frame, the outer face 314 of the base of the pressure device 240 being in contact with the inner face 231 of the frame,
- fastening the line of pressure devices 240 to the frame, preferably with a plurality of zip ties clasping tubes 300 or pressure devices 240 and the frame.

The invention provides therefore a method very simple and cost effective to obtain a medical vest for HFCWO treatments.

Figure 10:
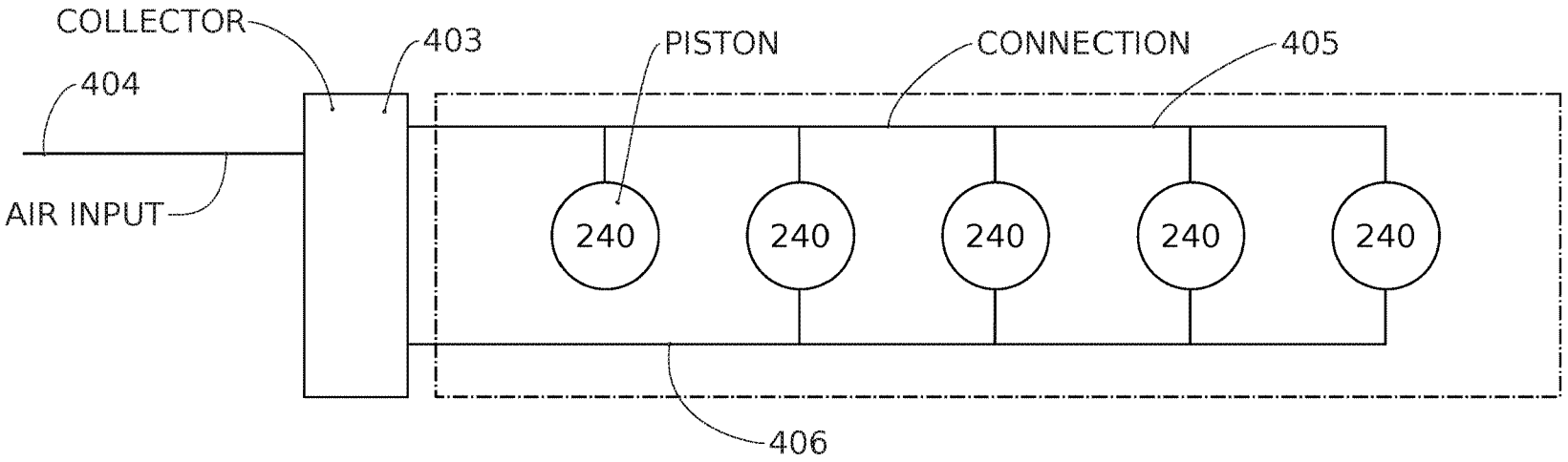
FIG. 10 is a schematic illustration of a part of an example of HFCWO system according to an embodiment of the invention, said HFCWO system comprising a plurality of pressure devices.

FIG. 10 illustrated an assembly of a plurality of pressure devices 240 incorporated in a medical vest 200 according to the invention. Five pressure devices 240 are mounted on the support sub-frame 265 of the rear frame 230 and connected to a collector 403 supplied with pressurized fluid through an input duct 404. In this illustrative embodiment, the five pressure devices 240 share the same duct 405 and 406 for supply and emptying. Thus a plurality of devices can be controlled simultaneously.

In one advantageous embodiment, the integration of several (i.e. 2 or 3) pressure devices 240 to form a set of pressure devices is feasible for production. Each set of pressure devices comprises a plurality of fixed connectors utilized for connecting to another set of pressure devices and also to the support sub-frame on which the set of pressure devices is mounted. Therefore, all the different size medical vest 200 can be broken down into either two or three pressure devices 240 or combinations of these, then connected with flexible tubing and attached onto the frames 220, 230. Compared to individually assembly the individual pressure devices 200 one by one, the cost of production and the time to assembly sets of pressure devices would be largely reduced.

The invention is not limited to the structure and/or the size and/or the production method of the pressure devices 240. Any equivalent device can be utilized as a substitution of the pressure device 240 if it can provide a similar function and be mounted on a support sub-frame (261-265) of the medical vest 200 according to the invention.

Therefore, the medical vest 200 provides at least the following technical effects and advantages:

(1) With the design of the frames 220, 230, the therapeutic pulsations provided by the pressure devices 240 can be directed to the most important and efficient areas of the thorax of a patient. The front frame 220 and the rear frame 230 when held against the body will provide even homogeneous resistance to the pressure devices 240 two-way movements focusing a greater percentage of the energy transfer onto the thorax therefore increasing the therapeutic efficiency and also making the pressure devices 240 be placed onto the patient much easier.

(2) The medical vest 200 provides a framework which not only keeps the head of the pressure devices 240 in the correct angle (i.e. 90 degrees) of strike for maximum efficiency of energy transfer, but it also allows the patient to precisely select a location on the thorax for maximum efficiency. These two factors together guarantee a much more efficient and consistent delivery of therapeutic pulsation to the patient's thorax.

(3) The long even form of the frames 220, 230 of the medical vest 200 also enables us to give a more even and homogenous resistance to the outward movement of the pressure devices 240, thereby focusing this towards the thorax. Even with a piece of clothes over the medical vest 200, the invention is still much more efficient than "loose" lines of pressure devoices that twist or slip away from the perpendicular position.

(4) The above embodiment shows that the medical vest 200 holds the pressure devices 240 in contact with the most important parts of the thorax for therapeutic pulsations, minimizing the amount of muscle and flesh between piston head and ribcage by largely avoiding the pectoral/breast zone which are very effective shock absorbers and greatly reduce the efficiency of therapy.

(5) The shape of the impact portion prevents the pressure device from applying against intercostal muscles instead of applying on ribs only, which enhances the efficiency of the treatment.

(6) The pressure device comprises only one part and therefore allows reducing the cost of the medical vest.

(7) The fastening of the pressure devices to the frame allows reducing the cost of the medical vest while effectively maintaining the pressure devices in their position perpendicular to the thorax to provide an efficient treatment. The elastic shroud participates to maintain the pressure devices in their correct position and overall enhances the homogeneity of the distribution of the pressures around the thorax.

From the above description, it appears clearly that the medical vest 200 according to the invention allows providing more gentle and efficient treatment while limiting the cost of the equipment. In addition, the robustness and lifetime of the pressure devices incorporated in the medical vest 200 are particularly good.

Some aspects, preferred but not limitative of a pressure device according to the invention will be mentioned below:

It is first recalled that according to an aspect, the invention relates to a medical vest for focused pulses High Frequency Chest Wall Oscillation (HFCWO) system, comprising at least a device comprising a deformable chamber and at least a port in communication with the chamber configured to let a pressurized fluid flowing alternatively in and out the chamber so that the inflatable device alternatively passes from an inflated configuration to a deflated configuration, characterized in that the device is configured to essentially expand along one single direction when it repetitively passes from the deflated configuration to the inflated configuration.

Optionally, the medical vest according to the invention may comprise at least one of the facultative and advantageous features below.

The device comprises elastic means configured to pass from a released position to a deformed position enabling thereby the medical vest to apply repetitive focused pulsations to the body of a human.

Said single direction is preferably a direction that is substantially perpendicular to the patient's body. Thus, each inflation of the device generates a focused pulsation or strokes having a force that is fully or at least mainly transmitted to the patient's body.

In the inflated configuration the elastic means are in a deformed position. In the deflated configuration the elastic means are in a release position.

The elastic means comprise at least a return spring. The device is configured so that it is deflated when the return spring is in a released position and so that it is inflated when the return spring is in an extended position.

The device comprises a body forming at least a part of the chamber, the body comprising the elastic means and being arranged to expand along said one single direction when the device passes from the deflated configuration to the inflated configuration.

The body is arranged to retract along a transverse direction also designated radial direction, which is substantially perpendicular to said one single direction when the device passes from the deflated configuration to the inflated configuration.

The length of the device increases and its width decreases when passing from the deflated configuration to the inflated configuration. The length is the dimension taken according to the direction of the axial deformation of the device. The width is the dimension taken according to the direction of the transverse deformation of the device. Preferably, when the device has a substantially cylindrical shape, its width corresponds to the maximal outer diameter of its body. The length of the device decreases and its width increases when passing from the inflated configuration to the deflated configuration.

Preferably, the variation of length between the deflated and inflated configurations is higher than the variation of width.

According to a preferred embodiment, the body is arranged to expand along a transverse direction that is substantially perpendicular to said one single direction and to retract along said single direction when the device passes from the inflated configuration to the deflated configuration.

Preferably, the body is made of a material that has a low elasticity at the pressures applied during use. Typically, the pressures inside the chamber do not exceed 350 millibars and are usually comprised between 100 and 350 millibars. However, the body can elastically deform according to a main direction. This direction corresponds to the longitudinal/axial direction of the body.

According to an advantageous embodiment, the body comprises bellows arranged for automatically decreasing the length of the body and bringing the device back to its deflated configuration when the chamber is not supplied with pressurized air. Thus the device is elastic thanks to its shape, i.e., thanks to the bellows. Preferably, the elasticity is not mainly brought by the elastic properties of the material forming the device.

Advantageously, the elastic means are formed by the bellows. Thus the body is arranged to form corrugations or pleats when the device is in its deflated configuration and wherein the corrugations or pleats are decreased or removed when the device is in its inflated configuration.

Preferably, once the device is in its deflated configuration, its length can still be reduced by applying a compression force on it. The body can thus be shrunken. When the compression force is released, the device passes from this shrunken configuration to its released configuration. This alleviates the compression of the patient's body when no pressurized air is supply to the chamber of the device, allowing thereby the patient the breath normally or (or to cough) quite normally.

Advantageously, the elastic means are made of silicon.

The device comprises a head configured to stroke the body of the patient during usage of the invention, a body substantially deformable along said one single direction and a base, the body extending between the base and the head.

Preferably, the head is essentially not deformable in use. Preferably, the base is essentially not deformable in use. According to a specific non limitative embodiment, the head and base are very different, the base is very thick and not deformable whereas the head is slightly deformable to adapt to contorts of the patient's thorax.

Preferably, the surface of the impact portion of the head is constant whatever is the configuration of the device: inflated or deflated. The impact portion of the head is the surface of the head that strokes the patient's body. The surface of the impact portion can be directly in contact with the patient's body or patient's garments. Preferably, the vest comprises a wall, between the head of the device and the patient's body.

The material is substantially inelastic in use but the device, thanks to its shape that incorporates bellows is elastic. The respective thicknesses of the various parts of the device also allow controlling the parts that do deform and the parts that do not deform during the use.

Preferably, the body is made of silicon, but differing thicknesses in different parts allow for deformation or resist deformation. For example the base is very thick and is hardly deformable whereas the sidewalls are thin and easily deformable and flexible allowing for the bellows effect.

The head in contact with the patient is slightly thicker to ensure maximum transmission of energy to the thorax of the patient whilst still remaining flexible enough to be comfortable for the patient. Thus, the elasticity of the device is mainly provided by the shape of the device, i.e. the bellows, and not mainly by the intrinsic elasticity of its material.

Thus, a non limitative feature of the invention is that the body is made of a material that is substantially inelastic during use, the elasticity of the device being mainly enabled by the shape of the elastic means.

Advantageously, the base comprises the at least one port. Preferably, the chamber is formed by the body, the head and the base.

According to an advantageous embodiment, the head and the body are made of silicon.

Advantageously, the head and the body are made of a single part. Thus the device is monolithic. The device is therefore made of a simple part which provides an increased robustness. Yet, robustness is an important aspect of the invention since the HFCWO system undergoes a very high number of compression and de-compression cycles. The cost of a medical vest according to the invention is also limited thanks to the device incorporated in the vest.

Advantageously, the body is attached on the base so that the chamber is sealed.

Preferably, the base is made of silicon with a thickness sufficient to be non-deformable.

Preferably, the body and base are both obtained by means of rubber stamping or injection molding technology. Two different molds are used to obtain the body and the base, then the two part are fixed together, typically thanks to a glue.

Advantageously, the body presents a shape substantially annular. This contributes to remove areas that could wear after a high number of repetitive inflation and deflation cycles, enhancing thereby the robustness of the device and the life span of the vest.

Advantageously, the medical vest comprises a plurality of housings, at least some of the housing comprising a device.

A housing has a first wall arranged to be in regard with the patient's body and a second wall arranged to be in regard with the outside during usage of the medical vest, the device comprising a head configured to be in contact with the first wall, a base configured to be in contact with the second wall and a body extending between the base and the head.

According to an advantageous embodiment, the devices are arranged in at least a line and preferably several lines. The lines can be substantially horizontal or vertical. (however, other configurations can be envisaged as practical for specific clinical applications, example individual pads of hand size which can attach with hook-and-loop fasteners (such as Velcro®) wherever they want the therapeutic pulsations to treat specific lobes of the lungs, mimicking direct chest physical therapy)

The foregoing description has provided by way of exemplary and non-limiting examples a full and informative description of various pressure devices and systems for implementing the exemplary embodiments of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of the embodiments of this invention.

Furthermore, some of the features of the exemplary embodiments of this invention may be used to advantage without the corresponding use of other features. As such, the foregoing description should be considered as merely illustrative of the principles, teachings and embodiments of this invention, and not in limitation thereof.

The invention claimed is:

1. A Medical equipment for High Frequency Chest Wall Oscillation HFCWO treatment configured to be worn on a thorax and arranged to apply repetitive compressions to the thorax, wherein the medical equipment comprises a plurality of pressure devices to apply the repetitive compressions and each comprising a deformable chamber and at least an inlet port for feeding the chamber with pressurized fluid and at least an outlet port for allowing the pressurized fluid to evacuate the chamber so that the pressure device alternatively passes from an inflated configuration to a deflated configuration, wherein the pressure device comprises a body forming at least a part of the chamber, a head (303) configured to stroke the thorax during usage, and a base, the body extending between the base and the head and comprising bellows arranged for automatically decreasing a length of the body and bringing the pressure device back to its deflated configuration when the chamber is not supplied with pressurized fluid, wherein the head, the body and the base form a single part, wherein the base comprises the inlet and outlet ports, wherein the medical equipment also comprises at least a frame configured to hold the pressure devices substantially perpendicular to the thorax, an outer face of the base being in contact with an inner face of the frame, wherein at least some of the pressure devices are aligned, two consecutive pressure devices being connected together by at least two tubes the distance D between the inner face of the frame and each tube connecting two consecutive pressure devices being inferior to 8 mm, wherein the medical equipment comprises at least a fastener that fastens the frame to at least one of the tubes or that fastens the frame to the pressure devices.

2. The medical equipment according to claim 1, wherein the distance between the inner face of the frame and each of the tubes connecting two consecutive pressure devices is inferior to 6 mm.

3. The medical equipment according to claim 1, wherein the tubes are in contact with the inner face of the frame.

4. The medical equipment according to claim 1, wherein the entire surface of the outer face of the base is in contact with the inner face of the frame.

5. The medical equipment according to claim 1, wherein at least three of the pressure devices form a line of pressure devices, at least two of these pressure devices each comprising four ports and wherein the tubes connecting two consecutives pressure devices are comprised in a plane that is substantially parallel to the inner face of the frame.

6. The medical equipment according to claim 1, wherein each port of the pressure device is permanently open during operation.

7. The medical equipment according to claim 1, wherein the at least a fastener fastens the frame to at least one of the tubes.

8. The medical equipment according to claim 1, wherein the at least a fastener comprises at least one single fastener that fastens the frame to the at least two tubes connecting two consecutives pressure devices, wherein the fastener surrounds and clasps the two tubes and the frame, and wherein the frame comprises at least a recess or at least a hole through which passes the fastener so that the fastener includes a tie that does not slide along a direction that is parallel to the tubes.

9. The medical equipment according to claim 8, wherein the shroud comprises at least a pocket configured to house at least a part of the frame so that the shroud holds the frame.

10. The medical equipment according to claim 1, wherein the frame comprises a plurality of support sub-frames configured to accommodate and fix the positions of the plurality of pressure devices, the plurality of support sub-frames forming strips able to comply with a shape of the thorax, each strip extending along one main direction, at least a binding support arranged to link at least two of the plurality of support sub-frames so as to prevent the plurality of support sub-frames from being twisted around their respective main direction.

11. The medical equipment according to claim 10, wherein the binding support and the support sub-frames are formed of a single piece.

12. The medical equipment according to claim 1, comprising a shroud (511) comprising at least an elastic portion and configured to surround an outer face of the frame so that it compresses the pressure devices onto the thorax when the medical equipment is worn.

13. The medical equipment according to claim 1, wherein the head of the pressure device comprises an impact face configured to apply repetitive compressions against the thorax and wherein the impact face has an elongated shape that mainly extends along one main direction, a dimension of the impact face along the main direction L being greater than three centimeters and being greater than 1.5 times a dimension W of the impact face according to a direction perpendicular to said main direction.

14. A method for fabricating the medical equipment according to claim 1, wherein the method comprises the following steps:

a step of forming a line of the pressure devices, this step comprising connecting a plurality of the pressure devices with the tubes, disposing the line of pressure devices on the frame, so that an outer face of the base of the pressure device is in contact with an inner face of the frame, fastening the line of pressure devices to the frame through clasping the tubes and the frame or through clasping the pressure devices and the frame.

15. A high Frequency Chest Wall Oscillation HFCWO system comprising the medical equipment, according to claim 1 and comprising a device for delivering a pressurized fluid to the pressure device.

* * * * *